US005681509A

United States Patent [19]

Bailey

[11] Patent Number: 5,681,509

[45] Date of Patent: Oct. 28, 1997

[54] APPARATUS AND METHOD FOR MIXING AND INTRODUCING GAS INTO A LARGE BODY OF LIQUID

[75] Inventor: Wayne A. Bailey, Hermosa Beach, Calif.

[73] Assignee: Biomixer Corporation, Hawthorne, Calif.

[21] Appl. No.: 565,455

[22] Filed: Feb. 1, 1996

[51] Int. Cl.[6] ..... B01F 3/04

[52] U.S. Cl. ..... 261/87; 210/220; 210/242.2; 261/120; 261/DIG. 47

[58] Field of Search ..... 261/87, DIG. 47, 261/120; 210/220, 221.2, 242.2

[56] References Cited

U.S. PATENT DOCUMENTS

| | | | |
|---|---|---|---|
| 915,372 | 3/1909 | Neill | 261/87 |
| 1,124,855 | 1/1915 | Callow et al. | 261/87 |
| 1,383,881 | 7/1921 | Thomas | 261/87 |
| 2,138,349 | 11/1938 | Mallory | 261/87 |
| 2,187,746 | 1/1940 | Letevre | 261/87 |
| 2,239,194 | 4/1941 | Fitzgerald et al. | 261/87 |
| 2,328,655 | 9/1943 | Lannert | 261/DIG. 47 |
| 3,630,498 | 12/1971 | Bielinski | 261/87 |
| 3,662,781 | 5/1972 | Figliola et al. | 210/221.2 |
| 3,677,528 | 7/1972 | Martin | 261/87 |
| 3,911,064 | 10/1975 | McWhirter et al. | 261/87 |

FOREIGN PATENT DOCUMENTS

| | | | |
|---|---|---|---|
| 195354 | 1/1958 | Austria | 261/87 |
| 1250266 | 11/1960 | France | 261/87 |
| 2023981 | 11/1971 | Germany | 261/87 |
| 955879 | 4/1964 | United Kingdom | 210/242.2 |

*Primary Examiner*—Tim R. Miles

*Attorney, Agent, or Firm*—Ashen & Lippman; Robert M. Ashen

[57] ABSTRACT

Improved apparatus and method for mixing and introducing gas into a large body of liquid. The apparatus supports and rotates a plurality of spoke-like discharge members below the surface of the liquid. The members have upwardly facing perforated discharge surfaces through which compressed gas is released up into the liquid. Preferably the members have non-porous lower portions. To counter upward "lift pump" effect forces created by the rotating members, the members are tilted with their leading edges lower than their trailing edges. The tilt of the members and the speed of rotation are balanced so that the resultant angle of attack of the liquid relative to the discharge surfaces is zero or slightly greater, for efficiently and effectively shearing the emerging gas into relatively small size bubbles. To counter the tilt of the members and maintain generally equalized flow across the width of the members, each member interior is divided into a plurality of radially extending plena, with the gas pressure in the plena being progressively greater starting at the leading edge. A control system may change (I) the depth of submergence of the discharge members to regulate dissolved gas infusion rate and (ii) speed of member rotation to maintain angle of attack.

39 Claims, 20 Drawing Sheets

FIG. 1-2C
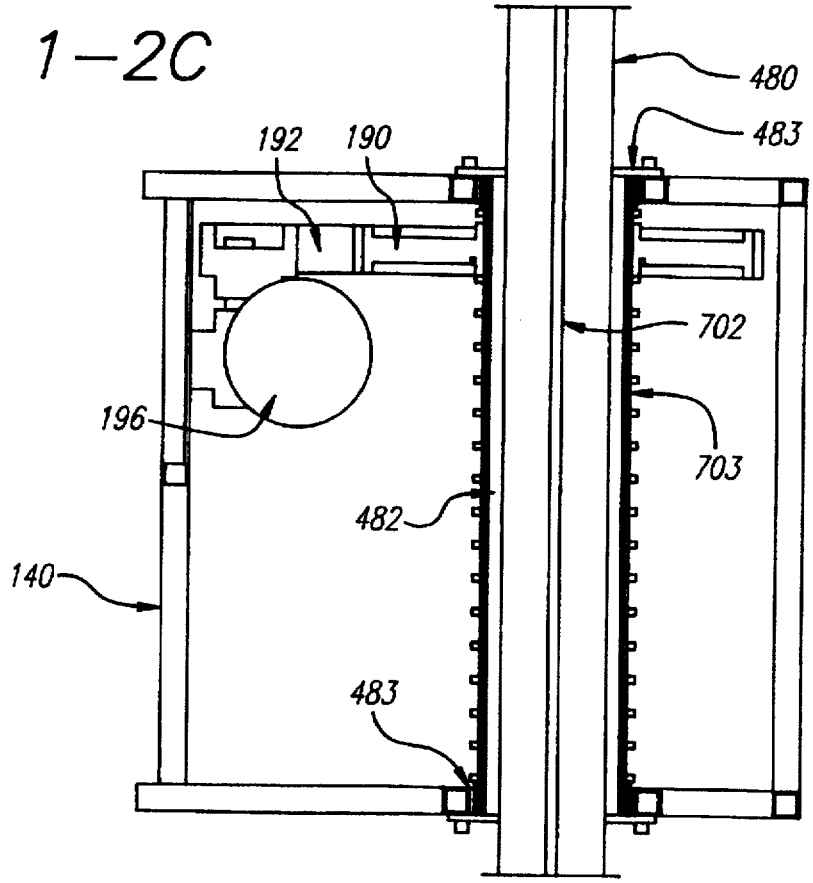
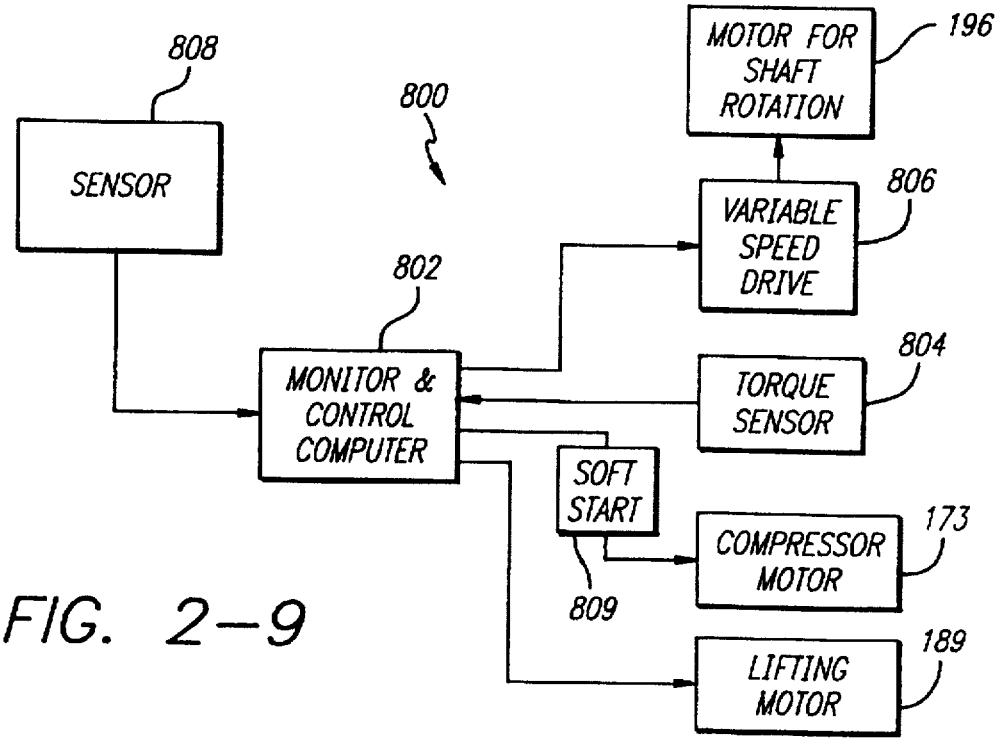
FIG. 2-9

FIG. 1-2D
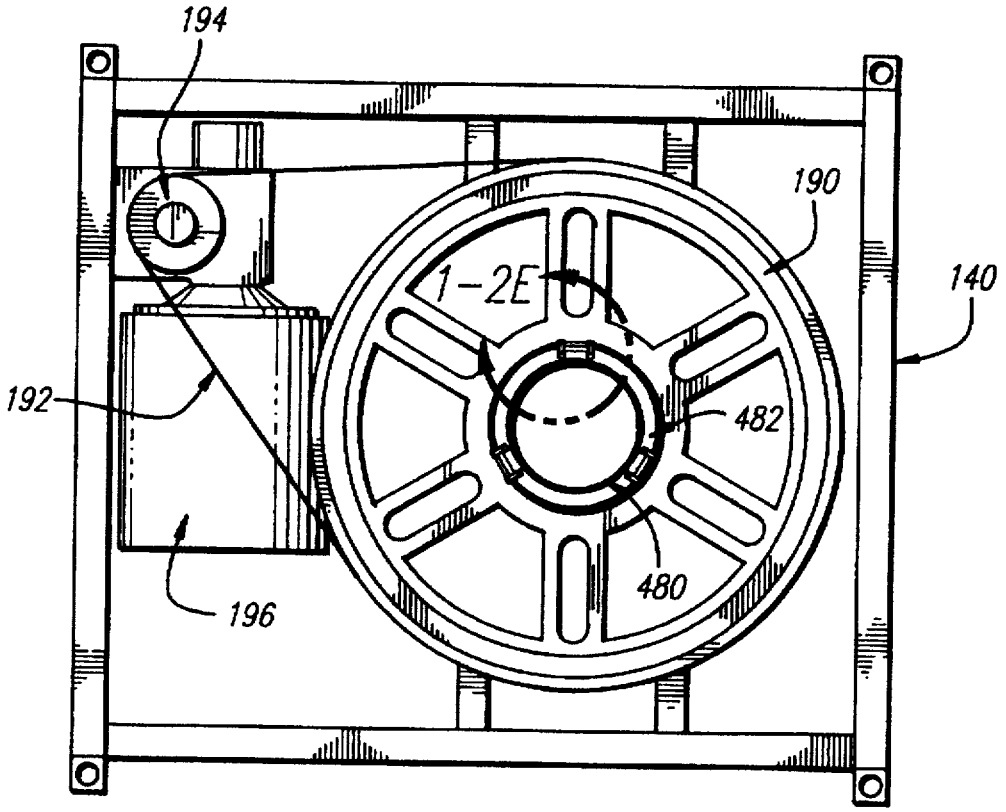
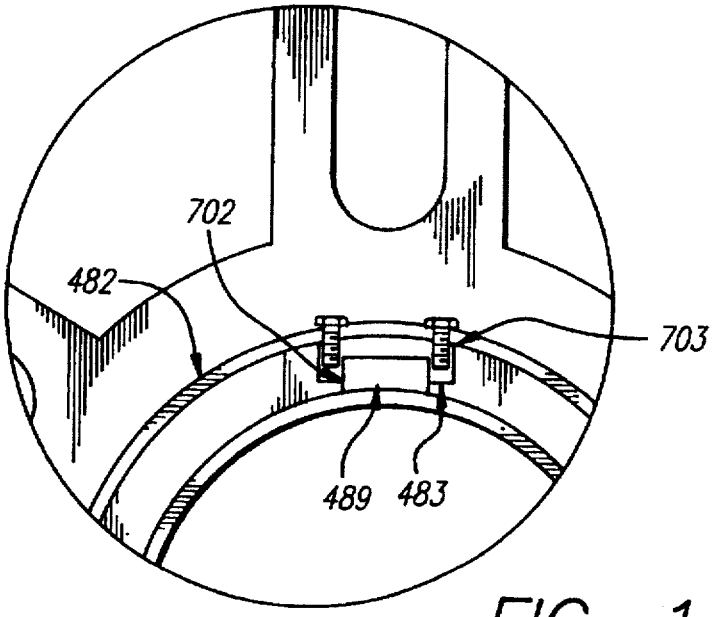
FIG. 1-2E

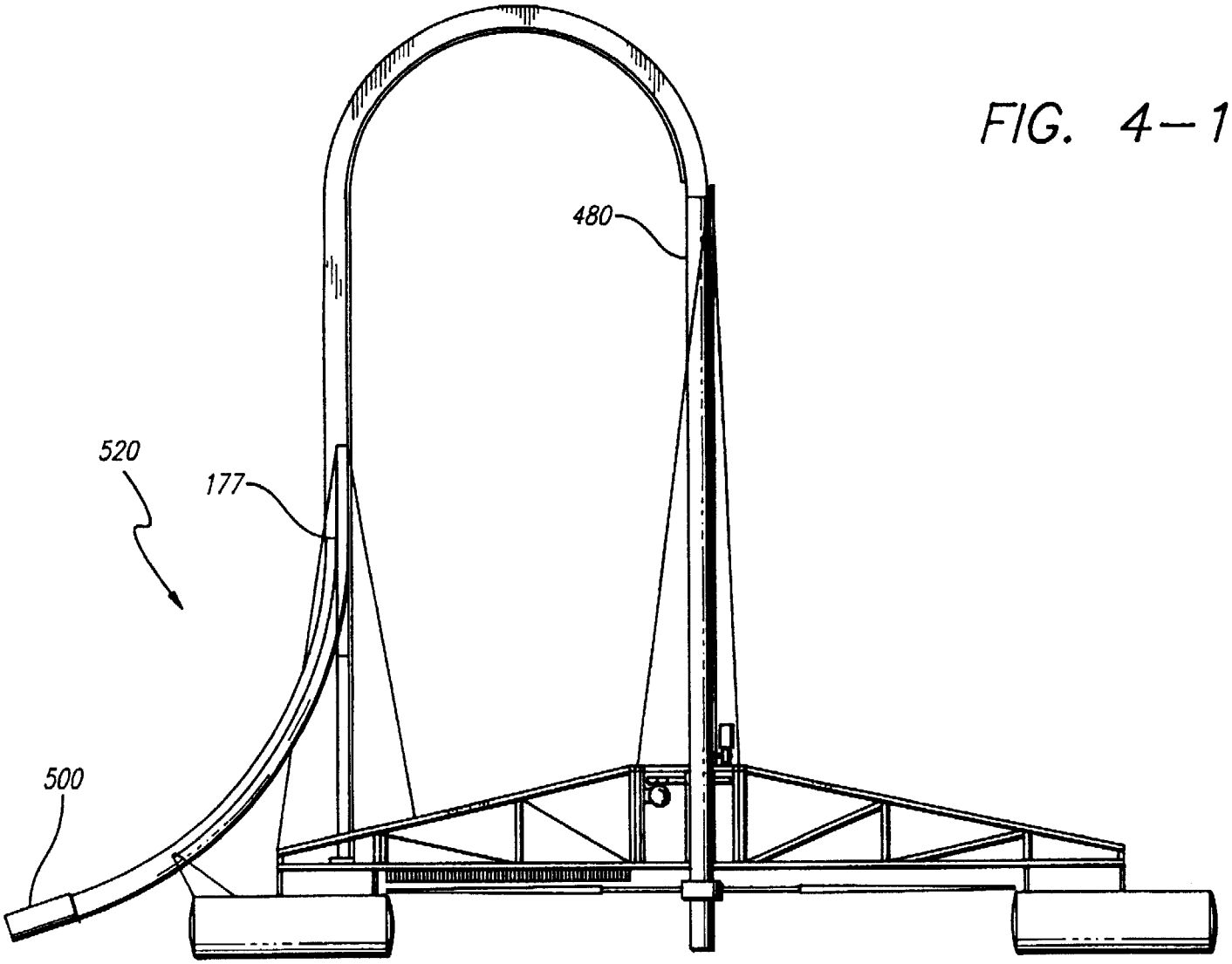
FIG. 4—1

APPARATUS AND METHOD FOR MIXING AND INTRODUCING GAS INTO A LARGE BODY OF LIQUID

FIELD OF THE INVENTION

Apparatus and method of introducing gas and dissolved gases into a large body of liquid, mixing such a body, and introducing admixtures into such a body.

BACKGROUND OF THE INVENTION

The present invention is an improvement over the various existing technologies for 1) introducing a gas additive into a large body of liquid, and/or 2) introducing admixtures into such a body, while concurrently 3) bulk mixing such a body.

Aeration and mixing have been used for treating water and other liquids for over one hundred years. During that time various methods, including the following, have been employed:

1. Compressor/diffusers use a suitable compressor to force gas below the liquid surface and through a diffuser. As the bubbles rise to the surface, gas is transferred from the bubbles to the liquid. Mixing is accomplished via the hydraulic resistance of the bubbles as they travel to the liquid surface. Diffuser types range from coarse bubble to fine bubble diffusers. Coarse bubble systems are more reliable, but energy-inefficient to operate, when compared to fine bubble systems. Fine bubble diffusers are at first more energy-efficient, but they frequently become fouled or clogged, resulting in decreased reliability. The fine-bubble diffusers, in particular, are limited in turn-down capability, due to increased fouling problems at lower gas flow rates.

There are compressor diffusers which utilize rotating gas diffuser in the form of a large flat horizontal disk-shaped unit. The gas is discharged from porous plates arranged completely around the circumference of the disk. This tends to produce gas flow where many of the bubbles follow in the path of preceding bubbles, thereby limiting the efficiency of the transfer of gas into the body of liquid. This will also interrupt the effective inflow of liquid into the reactor column and therefor limit its mixing efficiency.

U.S. Pat. No. 3,630,498 to Belinski shows the use of a small, high-speed rotating mixing and aerating element comprised of a pair of horizontal radially extending blades or foils. In operation, a partial vacuum is created in a zone of cavitation, which is formed behind the foils. Gas bubbles which emerge from the blades enter the zone of cavitation and expand due to the reduced pressure around the bubbles. While expanded, the bubbles are shattered by hydraulic forces into smaller bubbles. The shattered bubbles then exit the reduced pressure zone of cavitation and are further reduced in size as they are subjected to ambient pressure. Critical to the Belinski patent is the creation of the zone of cavitation. To create a zone of cavitation in a practical device, the foils must be short (such as 24 inches) and rotated at very high speeds (such as 450 RPM). Such a device is best suited for a smaller area. If the foils are made appreciably longer, the energy cost and physical loads of high-speed rotation quickly becomes prohibitive.

2. Surface Aerators use motors to drive impellers or blades near the surface. They either lift the water into the air, or aspirate air and inject it just below the surface. Surface aerators generally have a poor air transfer efficiency when compared to fine bubble diffused aeration systems. In other words they consume more horsepower hours of energy for each pound of dissolved oxygen they produce. In addition, mixing from surface aerators is generally limited to liquid near the surface. Also, mixing energy tends to be point loaded at or near the impeller. Localized zones of high shearing forces tend to damage delicate floc structures necessary for proper liquid clarification. Further, they are limited in the length of the shaft overhang, and have a limited shaft bearing life.

3. Turbine/Spargers use compressors to force and distribute a gas under the liquid surface. They also use a submerged impeller located just above the diffuser (sparger) to shear the bubbles and provide bulk mixing. Disadvantages of turbine spargers are similar to those for surface aerators with the additional disadvantage that the turbine sparger needs a source of compressed gas such as a compressor.

4. Jet Aerators use a liquid pump and an eductor to entrain gas into the liquid using the Venturi principle, as in U.S. Pat. No. 4,101,286. Jet aerators may be equipped to mix additional gas, liquid, or solid chemicals into the bulk liquid. They are reliable, have good turn down capability, and tend to be good mixers; however, they are inefficient aerators.

5. Blade Diffusers The early patent to Ingram U.S. Pat. No. 1,383,881, issued Jul. 5, 1921, shows a flotation apparatus having rotating blades that dispense gas bubbles into a body of liquid. The design of these blades is dictated, however, by the requirement that they also act as impellers to rotate the blades as well as discharging the gas bubbles. The blades are pitched so that the leading edges are elevated about 45°. As a result, the emerging gas is formed into elongated and then enlarged bubbles, which provide less efficient introduction of the gas into the liquid. In addition, examination of the patent and our research indicates that the blades would rotate in the opposite direction than is indicated in the Ingram Patent. This would result from the upward flow of fluid caused by the fluid lift pump effect of the released gas moving upward toward the liquid surface. Such vertical water flow across the pitched blades would appear to in fact cause rotation opposite that which is indicated in the patent.

SUMMARY OF THE DISCLOSURE EMBODYING THE INVENTION

1. IN GENERAL

The illustrated apparatus and method embodying the present invention provide excellent aeration or other infusion of gas into a large liquid body together with mixing of that body, in an effective and energy efficient manner. Various problems and limitations of the prior art are met and overcome.

2. DIFFUSER ASSEMBLY IN GENERAL

In the illustrated apparatus a gas diffuser assembly is suspended and rotated below the surface of the liquid body. The illustrated assembly includes a plurality of elongated radially-extending spaced part diffuser members or blades. The illustrated blades have generally upwardly directed discharge surfaces which have perforations from which pressurized gas is discharged as the blades rotate. As the gas is discharged, the rotation of the members produces relative flow of liquid over the diffuser surfaces. This flow shears the emerging gas flow and directly forms the gas into bubbles that are substantially smaller in size than would be produced if the members were stationary. The smaller bubble size exposes more surface to the liquid for greater gas transfer for a given volume of gas.

The members are relatively long such as 8 feet or more in diameter so as to span a large area. The members rotate at a speed that is slow enough to conserve energy but which is sufficiently fast to cause both shearing of the bubbles and the uniform distribution of the gas across the area spanned by the members.

The illustrated apparatus provides very good aeration and mixing of the liquid body, particularly because of the following factors:

1) Since the bubbles are formed from a moving gas plenum composed of spaced-apart radially extending elements, the gas is distributed evenly over a large area yielding less point source loading of the gas and less point source loading of mixing energy.

2) The bubbles are not forced to follow in the trailing path of previously released bubbles. The liquid in the path of bubbles that follow in the paths of previously released bubbles is typically relatively rich in dissolved gas, thus making the mass transfer diffusion gradient lower, than for bubbles which do not travel in the path of previous bubbles. A driving force causing the gas to dissolve in the liquid is the difference between the dissolved gas concentration of the liquid and the saturation concentration of the gas in the liquid. By moving the plenum and diffuser material, the illustrated apparatus exposes each subsequent bubble released from a pore to a new path and liquid environments. The liquid in this new path approaches the dissolved gas concentration of the ambient liquid surrounding the apparatus. Therefore, the mass transfer driving force of the gas is greater than with other aeration systems using stationary diffuser configurations.

3) Because of the spoke-like arrangement of the diffuser members or blades, ambient liquid is able to enter the "reactor column" (the volume of water above the diffuser) between the blades. This ability to enter the reactor column increases the turn-over of water in the reactor column, thus increasing the mass transfer diffusion gradient (see #2 above) and increased mixing.

These three factors result in a high mass transfer of the gas into the liquid, because bubbles are constantly being exposed to relatively non-aerated liquid, as compared to the other technologies described above, and also because of better bulk mixing.

3. ANGLE OF ATTACK—TILTING OF BLADES

To maximize the shearing effect of the flow of liquid relative to the rotating members, it is desirable that the resultant angle of attack of the discharge surfaces of the members with regard to the relative liquid flow be essentially zero or somewhat greater. In other words, such flow should be generally parallel to or tangential to such surfaces.

To achieve this zero angle of attack, the illustrated diffuser assembly is designed to take into account the effect of the upward discharge of gas. In this regard, such discharge of gas causes an upward flow of the liquid in a cylinder or reactor column that is an upward extension of the circle defined by the rotating blades. More particularly, such discharge of gas produces a zone of liquid above the blades which, due to the presence of gas bubbles, is less dense than the ambient liquid below the blades. This less dense liquid is displaced vertically upwardly from below by ambient density liquid. The vertical upward flow of the less dense liquid is called the lift pump effect. The ambient liquid that displaces the rising less dense liquid enters the reactor column between the rotating blades. This upward flow of ambient liquid affects the angle of attack between the rotating blades and the ambient liquid.

To achieve the desired zero angle of attack, in view of such lift pump effect, the illustrated members are tilted or pitched in the direction of rotation, i.e., leading edges are lowered.

FIG. 2–5 illustrates the plane of the discharge surface 485 of the rotating blade relative to the resultant vector 614 of the liquid. The resultant vector 614 is the vector sum of (i) the horizontal vector 613 produced by the member's rotating forward motion, and (ii) the vertical vector 616 produced by the liquid column's upward motion. When the angle of the discharge surface 485 essentially coincides with the angle of the resultant vector 614, the desirable angle of attack of approximately zero is achieved.

It may be seen from this relationship that, for a given tilt or angle of incidence of the member surface, the desired zero angle of attack can be maintained over a range of lift pump effect vertical liquid flow rates by selectively varying the speed of rotation of the members. The vector analysis diagrams in FIGS. 2–5, 2–5*a*, and 2–5*b* show the relationship between the vector 613 in the horizontal plane determined by speed of rotation of the blade, the vector 616 determined by the vertical speed of the rising liquid, the angle of incidence of the blade discharge surface 485, and the vector sum of the vectors 613 and 616 as represented by resultant vector 614. The angle at which the rotating inclined diffuser surface 485 is impacted by the liquid is the angle of attack and is shown as the angle between resultant vector 614 and surface 485.

FIG. 2–5 shows the generally optimal condition for bubble formation and energy use. The speed of rotation has been balanced with the speed of vertical liquid rise to yield a resultant vector 614 which slightly greater than the angle of incidence of the surface 485. The angle of attack, as indicated between vector 614 and surface 485, is slightly positive.

FIG. 2–5*a* shows another condition where the vertical speed of the liquid is slowed due to change in viscosity, diffuser submergence, basin geometry, etc. making the vertical vector 616 relatively short and changing the resultant vector 614*a* so that the angle of attack is greater than desired. This condition would result in increased torque required to rotate the diffuser assembly, excessive energy use, and increased stress on the blades and to drive mechanism. To correct this condition, the speed of rotation is slowed to shorten the horizontal vector 613 until the resultant vector 614*a* equals zero or slightly greater.

FIG. 2–5*b* shows the opposition condition where the vertical speed of the liquid is increased due to change in viscosity, increased diffuser submergence, etc. so that the vertical vector 616 becomes relatively larger and the resultant vector 614*b* is changed, whereby the angle of attack is less than desired. This condition would result in decreased torque required to rotate the diffuser assembly and larger gas bubbles. To correct this condition, the speed of rotation is increased to lengthen the horizontal vector 613 until the resultant vector 614*b* again equals zero or slightly greater.

4. STATIC HEAD PRESSURE DIFFERENTIAL—SPREADING THE DISCHARGE ACROSS THE WIDTH OF BLADES

The illustrated diffuser assembly is further designed to deal with an effect of the tilt of the discharge members. The incline of the discharge members described above causes a difference in liquid submersion and therefore a static head pressure differential between the leading and trailing edges of the members. This static head pressure differential would cause more gas to flow from the area of the trailing edge than from the area of the leading edge. This would be understandable as it would tend to produce large size gas bubbles. The illustrated discharge members are constructed to prevent this uneven air flow.

In this regard, the illustrated members are each constructed with a central inferior gas supply channel that extends the length of the member and connects to and is in communication with the hollow center shaft. The channel feeds a plurality of superior gas distribution plena that extend generally the length of the member and are arranged side by side across its width. Depending on the physical dimensions of the blade and the pitch of the blade, the number of superior plena may be varied between two and ten. It has been found that less than two plena causes uneven air flow across the blade and more than ten plena results in a reduced flow from the porous diffuser surface area due to the areas blocked by the bonding lines between the separating walls and the underside of the porous diffuser surface. The superior plena are disposed beneath the porous wall that provides the discharge surface for the member.

The superior plena are maintained at progressively different pressures. In the illustrated apparatus, there are three superior plenum: The superior plenum at the leading edge is maintained at the highest pressure, the superior center plenum is maintained at somewhat less pressure, and the superior plenum at the trailing edge is maintained at the least pressure. This may be accomplished by maintaining separation between the central inferior plenum and the leading, central and trailing superior plena. Flow between the central inferior plenum and the superior plena is allowed only through ports which allow communication between the central inferior plenum and the superior plenum through the separating wall. The size and number of ports in the separating walls between the central inferior plenum and the superior plena are designed such that the differential pressure between each pair of adjacent superior plena generally equals the static head pressure differential experienced by that pair of plena. The static head pressure differential results from the different depth of submergence of each plenum as a result of the pitch of the blade.

The gas passes from the supply channel to the superior plenum through ports in interior walls. In the illustrated apparatus, these interior walls and ports are arranged so that the gas flow into the superior plenum is generally tangential to the underside of the porous wall so as to reduce undesirable back pressure.

5. SPREADING GAS DISCHARGE ACROSS COLUMN WIDTH

To more uniformly spread the gas across the liquid body, the discharge assembly is design so that more gas is discharged at the radially outer portions of the member than at the radially inner portions of the members. In the illustrated apparatus, this equalization is accomplished by providing a wider discharge surface at the outer portion of each member than at the inner portion of that member. In one form each member generally has a trapezoidal or triangular shaped diffuser surface. In addition, the porting from the central inferior plenum to the superior plena may be designed to accommodate the differences radially from center to tip in the relative surface area of the superior plena porous walls.

6. DISCHARGING AN ADMIXTURE

For discharging secondary gases, fluids or the like (an "admixture") into the liquid body, each blade or member may have one or more separated sealed secondary chambers or inferior plenum that extend radially along the member and may have their own discharge parts for discharge of the admixture into the liquid body. The admixture carried by those secondary chambers may be released directly into the liquid body via ports in the outer wall of the diffuser member. Alternatively, the admixture may be released into the liquid via the porous wall. In the latter case, one or more superior plenum are not provided with ports to the central inferior plenum for discharge of the primary gas. Instead this superior plenum is provided with ports to the secondary inferior plenum which carries the admixture. Once the admixture is release into the superior plenum it is introduced via the porous wall into the liquid.

7. SUPPORT AND OPERATING STRUCTURE

Several different embodiments of structure are illustrated for supporting, rotating and raising and lowering the discharge assembly in the body of liquid.

In general for all of the embodiments, a plurality of floats support a frame upon the surface of the body of water contained in a basin. A compressor may be mounted on the frame. The frame also supports a hollow vertical main shaft that extends downwardly beneath the surface of the body. The diffuser assembly is supported at the lower end of the shaft. The shaft has an internal passageway that communicates with the compressor or another source of compressed gas. In different embodiments, the shaft is either tilted or moved vertically to raise and lower the diffuser assembly. In both cases this allows the diffuser members to be lifted out of the liquid body for start-up, cleaning, repair, power off and other reasons. In the case where the shaft is vertically raised or lowered, this allows the diffuser submergence level to be selectively changed to provide a way to control the rate of gas infusion into the liquid.

In the illustrated apparatus, a simple mechanical means such as a gear, chain, or belt drive off of a motor or gear-motor provides high torque to rotate the diffuser members.

8. CONTROL SYSTEM

It is desirable to be able to selectively adjust the rate of infusion of the gas into the liquid body.

The illustrated apparatus allows this rate to be changed by changing the depth of submergence of the diffuser assembly. More particularly, the depth of gas release determines both the efficiency of gas transfer into the liquid and also the system backpressure. The greater the depth, the higher the efficiency and infusion rate, and visa versa. Changing the depth of submersion may be done manual or automatically in response to various sensed parameters such as dissolved oxygen (DO), Biological Oxygen Demand, PH, etc., level in the water.

In another embodiment, the compressor output may be selectively changed in response to changes in such parameters to change the rate of gas infusion.

The control system may also allow change (manual or automatic) of the speed of rotation to maintain the desired angle of attack. In one form this may be accomplished by a variable speed drive controlled by feedback from a sensor which measures horsepower required to rotate the members.

9. CLOGGING/CLEANING

The design of the illustrated apparatus results in fewer clogging problems because:

1) Hydraulic flow across the blades inhibits the formation of bacterial colonies and their by products on the diffuser surface.
2) Control of dissolved gas production and energy consumption in conventional systems is accomplished by varying the gas flow rate to the diffusers. The reduced flow rate which occurs during low dissolved gas production frequently leads to fouling. In one embodiment the apparatus fouling is reduced by maintaining a constant gas flow rate. Dissolved gas production and energy consumption are varied not by changing the gas flow rate but by changing the diffuser submergence level.
3) The flat side of the blades may be impacted by a jet stream of water or other liquid from a nozzle located on the frame when the blades are above the surface of the liquid. The blades may be rotated and the height varied such that all of the diffuser surface is cleaned by one or more stationary liquid stream.
4) Fouling is further reduced because the blades may be retracted out of the liquid during any periods that the apparatus is not in operation.

10. SAFETY VALVE SELF-ADJUSTING TO DEPTH

The illustrated diffuser assembly also includes a self-adjusting automatic pressure release or safety valve arrangement which automatically adjusts to different depths of diffuser submergence. The arrangement comprises generally a rigid or semi-rigid downward hollow extension. This extension is in communication with the diffuser assembly and either open at the lower end or contains a one way valve at the lower end. This extension allows a release of the gas whenever the differential pressure between inside and outside of the discharge members exceeds the length of the extension (in inches of liquid) plus the pressure required to open the check valve. The check valve prevents the free flow of ambient liquid into the interior of the diffuser assembly which could cause fouling of the diffusers.

BRIEF DESCRIPTION OF THE DRAWINGS

FIG. 1-2 is a further enlarged schematic side view of the apparatus of FIG. 1-1 with the discharge assembly in its retracted position.

FIG. 1-2A is an enlarged schematic view (rotated 90 degrees) of a circled portion of FIG. 1-2.

FIG. 1-2B is an enlarged schematic view (also rotated 90 degrees) of another circled portion of FIG. 1-2.

FIG. 1-2C is an enlarged schematic side sectional view taken generally along the line C—C of FIG. 1-3.

FIG. 1-2D is an enlarged schematic top plan section view taken generally along line D—D of FIG. 1-2.

FIG. 1-2E is enlarged schematic view of a circled portion of FIG. 1-2D.

FIG. 1-3 is a schematic top plan view of the apparatus of FIG. 1-1.

FIG. 1-3*a* is a schematic top plan view of the apparatus, illustrating it rigidly supported at the sides of the basin.

FIG. 1-3*b* is a schematic side view of the apparatus of FIG. 1-3*a*.

FIG. 2-1 is a schematic side view of a lower portion of the shaft shown in FIG. 1-1 where it connects to the blades of the discharge means of the apparatus.

FIG. 2-1*a* is a schematic side sectional view taken generally along line A—A of FIG. 2-1.

FIG. 2-2 is a schematic top plan view (with portions removed) of one of the blades of the discharge means.

FIG. 2-3 is a schematic cross-sectional view of one of the blades taken adjacent to its radially inward end.

FIG. 2-4 is a schematic cross-sectional view of the blade shown in FIG. 2-3, taken adjacent to its radially outer end.

FIG. 2-3*a* is a schematic cross sectional view of an alternative embodiment of one of the blades taken adjacent to its radially inward end.

FIG. 2-4*a* is a schematic cross sectional view of an alternative embodiment of one of the blades taken adjacent to its radially outer end.

FIG. 2-5 is a schematic illustration of the angle of incidence of the discharge surface of a blade relative to its movement through the liquid in which the blade is immersed.

FIG. 2-5*a* is a schematic illustration of an excessively positive angle of attack of the discharge surface of a blade relative to its movement through the liquid in which the blade is immerse.

FIG. 2-5*b* is a schematic illustration of a negative angle of attack of the discharge surface of a blade relative to its movement through the liquid in which the blade is immersed.

FIG. 2-6 is a schematic view of a diffuser blade with the porous material removed, illustrating the differential porting to the superior plena.

FIG. 2-7 is a schematic plan view of the pore distribution of an alternative diffuser material.

FIG. 2-7*a* is an enlarged schematic view of a circled portion of FIG. 2-7.

FIG. 2-7*b* is an enlarged schematic view of another circled portion of FIG. 2-7.

FIG. 2-8 is an enlarged schematic side view showing the sealed rotating joint between the main shaft and the gas supply duct.

FIG. 2-9 is a block diagram illustrating the operation of the monitor and control mechanism of the apparatus.

FIG. 3-1 is a schematic side view of mixing and aerating apparatus which embodies another currently preferred form of the invention.

FIG. 3-2 is an enlarged schematic side view of the upper portion of the apparatus of FIG. 3-1.

FIG. 3-3 is a schematic top plan view of the apparatus of FIG. 3-1.

FIG. 3-4 is a schematic side view of the apparatus of FIG. 3-1, with the central shaft and diffuser assembly in the upwardly tilted position.

FIG. 4-1 is a schematic side view of a portion of another alternative embodiment of mixing and aerating apparatus where compressed gas is secured from an external source.

FIG. 4-2 is a schematic top plan view of the apparatus of FIG. 4-1 combined with another like apparatus and both coupled to a common gas compressor.

DETAILED DESCRIPTION OF THE DRAWINGS

INTRODUCTION

FIGS. 1-1 through 2-9 illustrate a currently preferred embodiment 420 of the invention. In this embodiment, the diffuser assembly 490 may be selectively adjusted by changing the effective vertical height of the support shaft 480.

Figure 1:
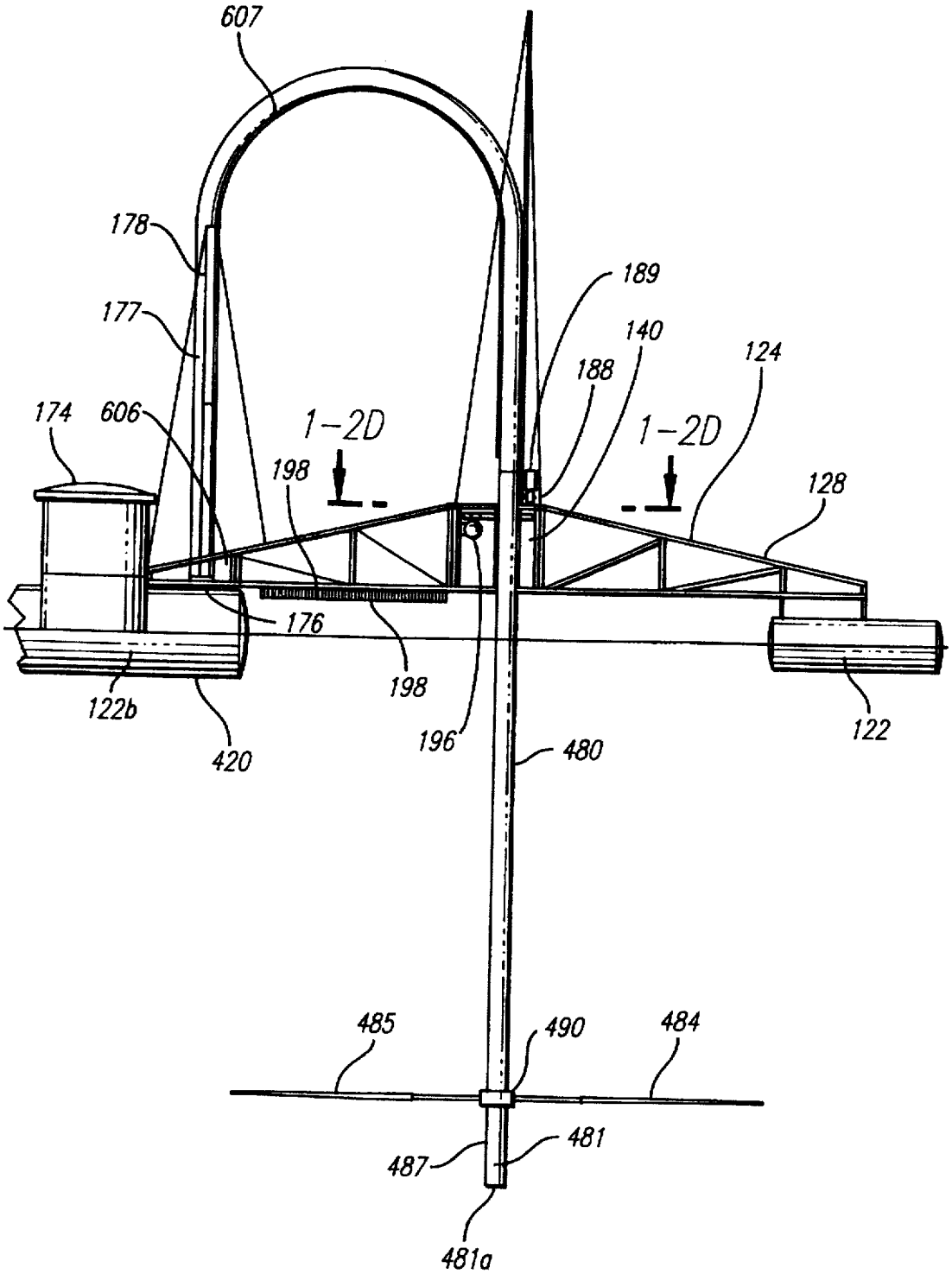
FIG. 1-1 is a schematic side view of mixing and aerating apparatus which embodies one currently preferred form of the invention.
Figures 1, 2, 2A:
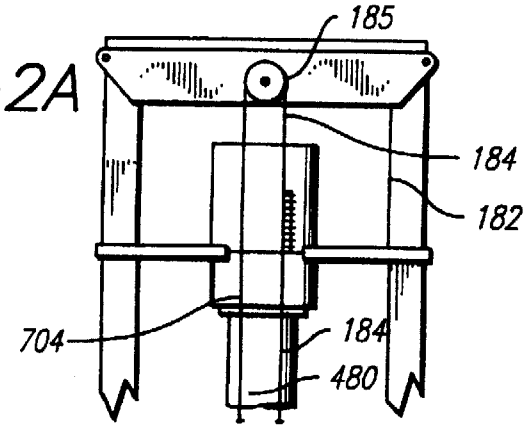
Figures 1, 2, 2B:
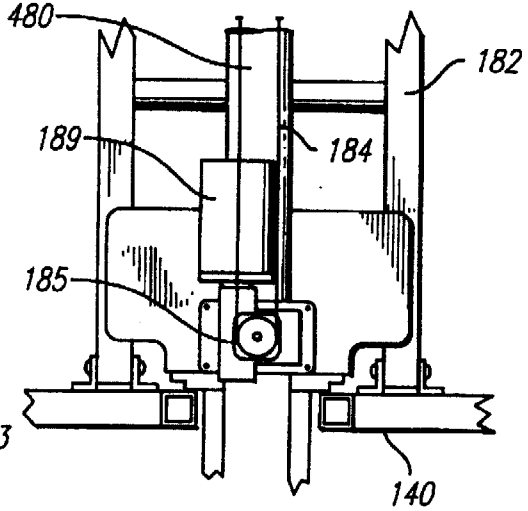
Figures 1, 2:
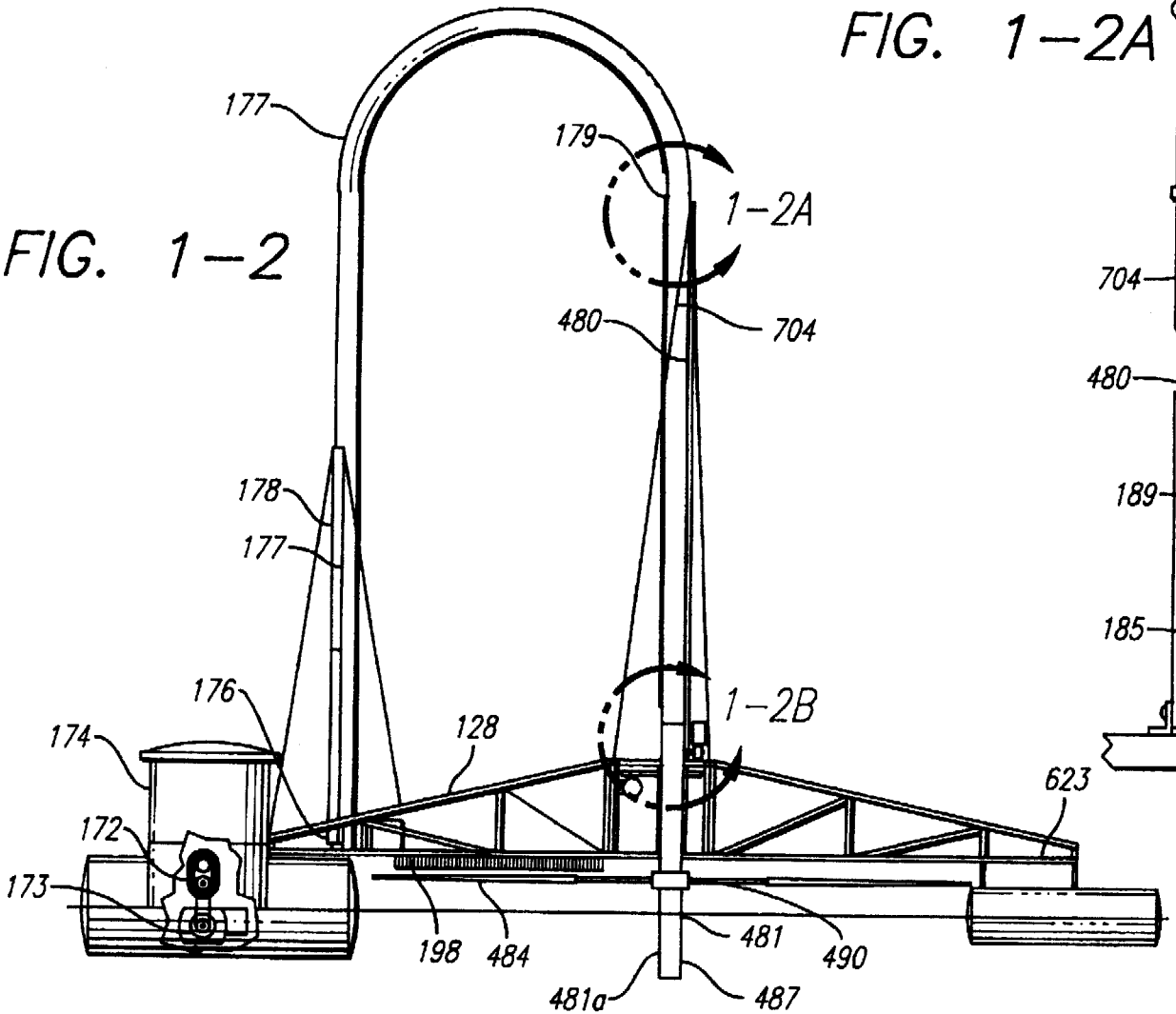
Figures 1, 2, 3:
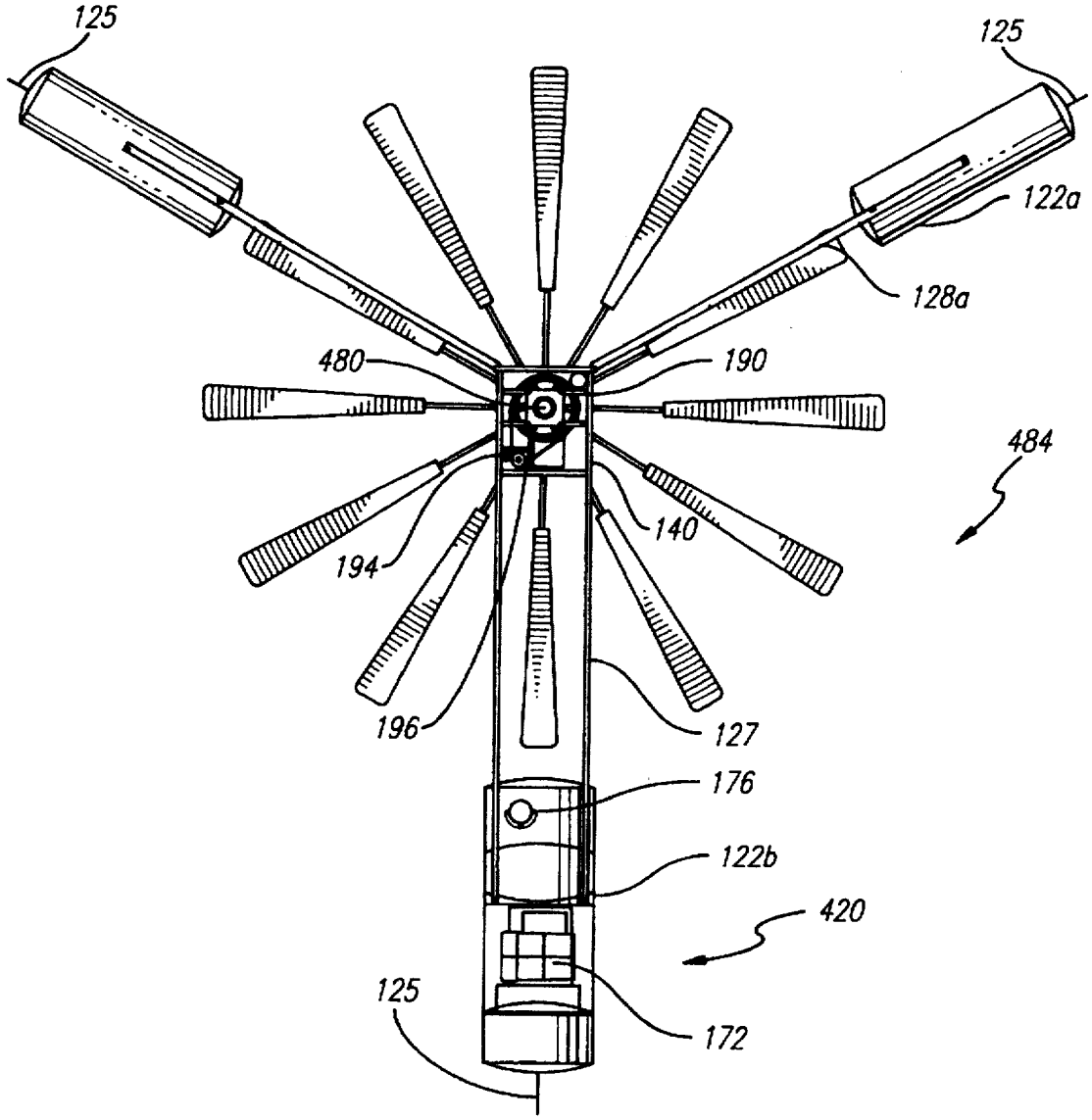
Figures 1, 2, 3, 3B:
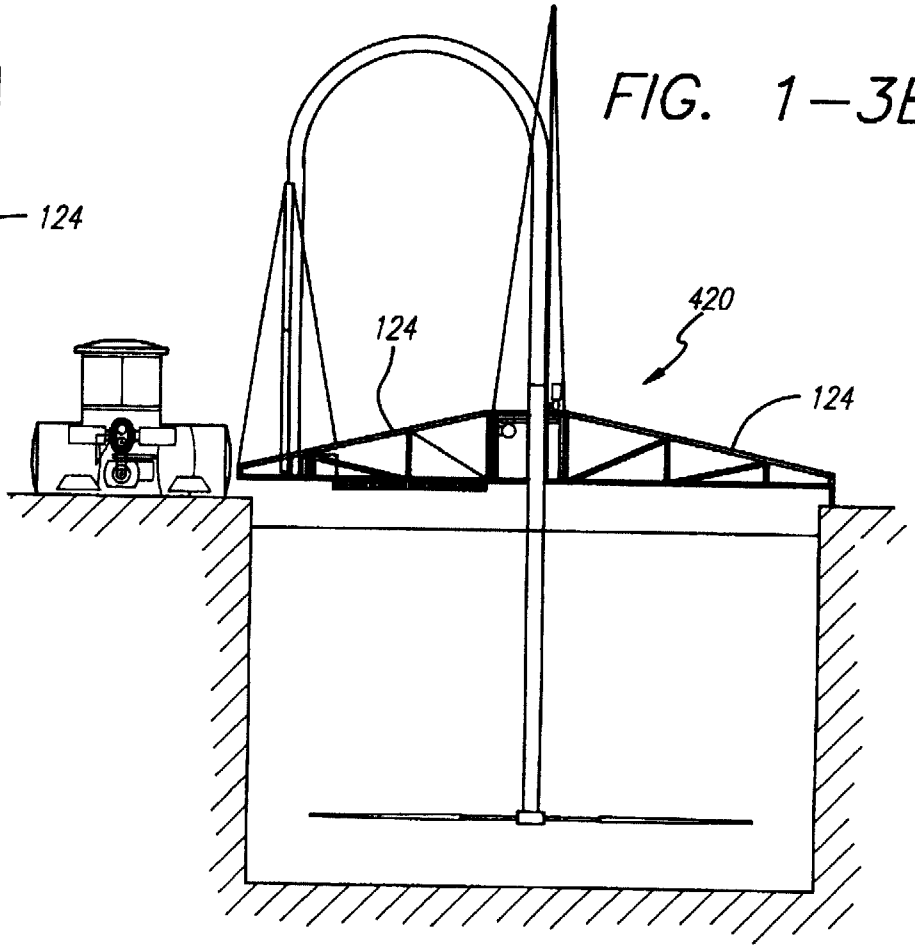
Figures 1, 2, 3, 3A:
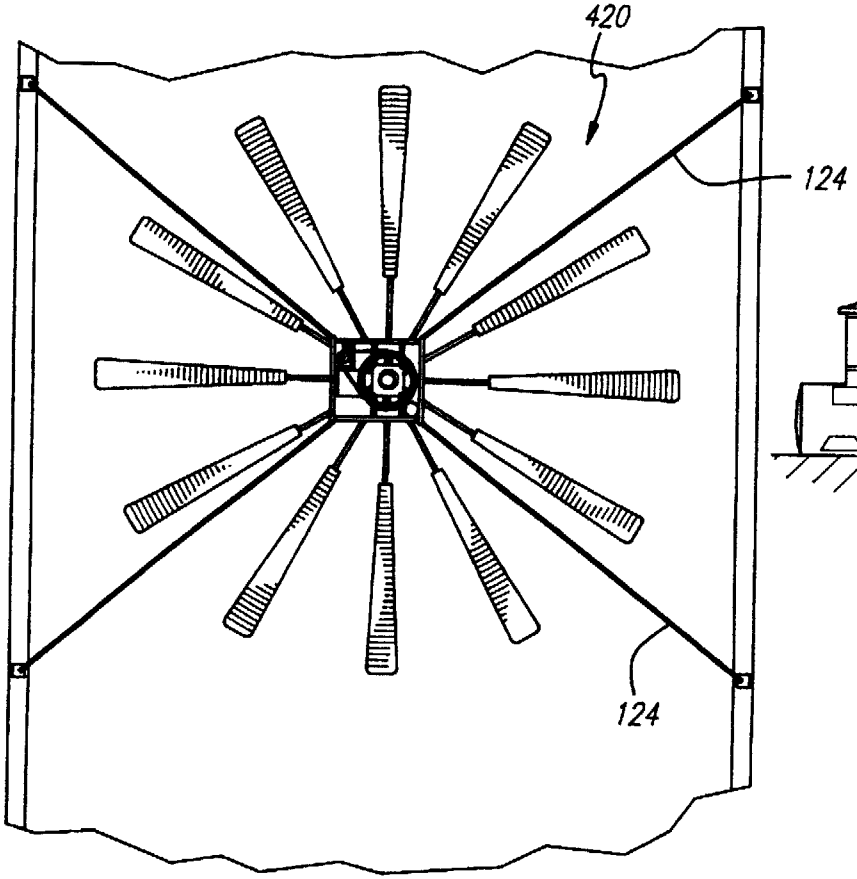
Figures 1, 2:
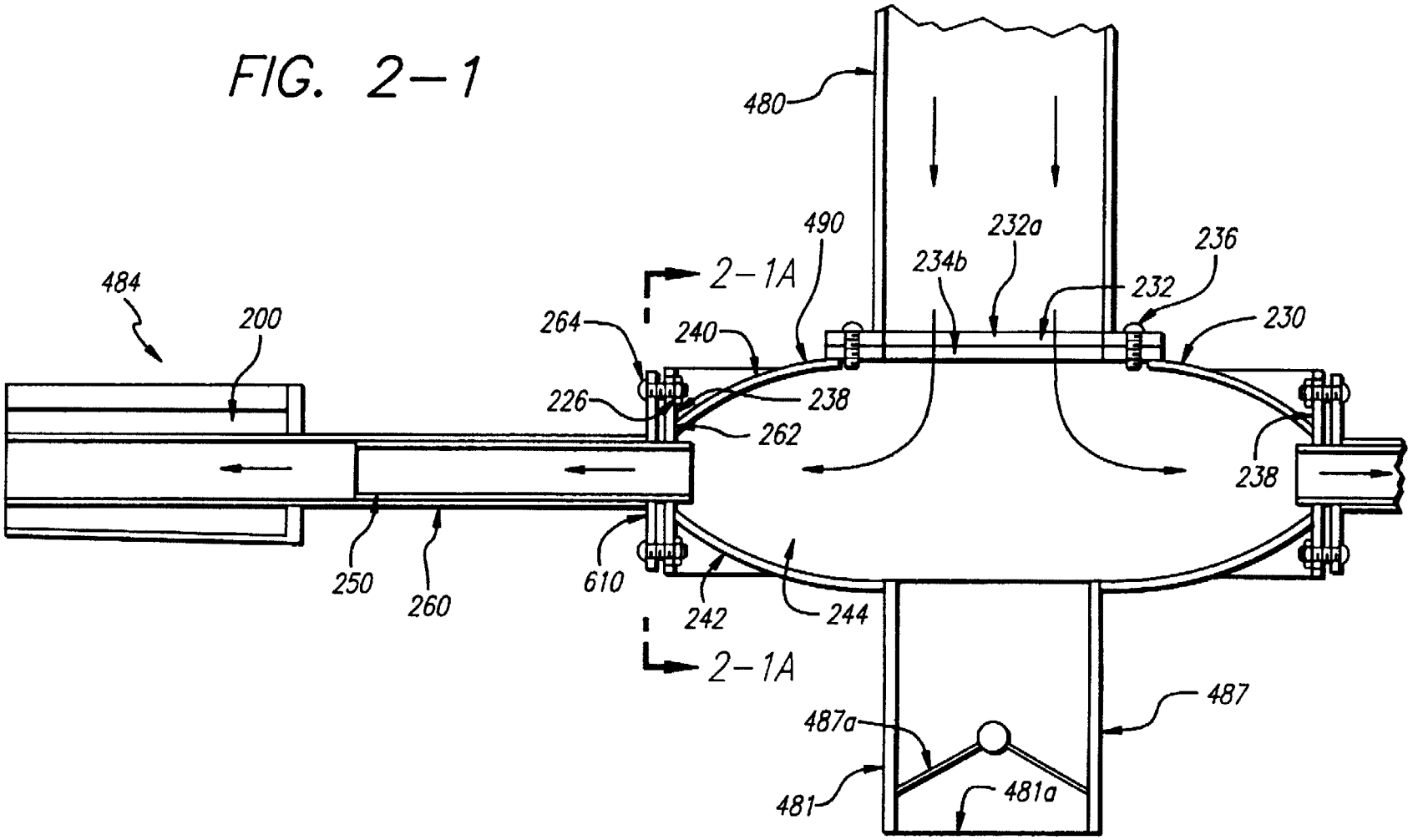
Figures 2, 3, 4, 5, 6, 7, 8:
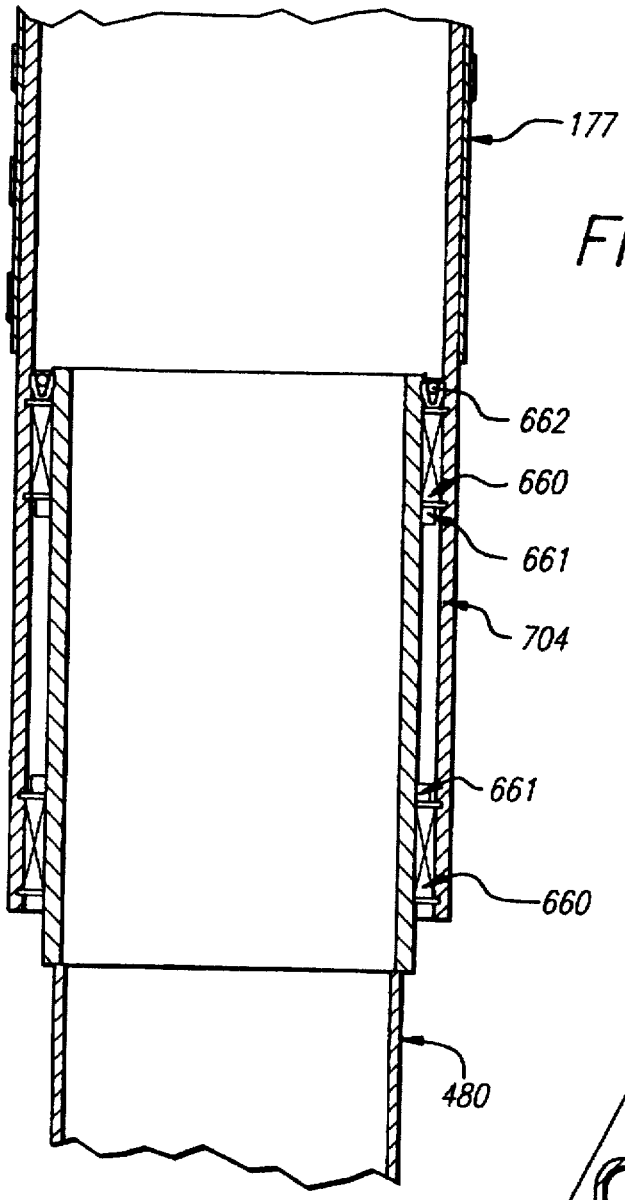

FIGS. 3-1 through 3-4 illustrate a second currently preferred embodiment 320 of the invention. In this embodiment, the diffuser assembly 490 may be selectively removed from its immersed position by tilting the support shaft 380. Embodiment 320 is otherwise very similar to embodiment 420.

FIGS. 4-1 illustrates an alternative embodiment 520 much like embodiment 420 but wherein the compressor and its drive motor are replaced by a connection to a remote source of compressed gas.

DETAILED DESCRIPTION OF THE DRAWING PREFERRED EMBODIMENT—MODEL 400—OVERVIEW

FIGS. 1-1 through 2-9 illustrate the most current and one presently preferred embodiment 420 of the invention. This apparatus 420 broadly comprises a plurality of floats or flotation members 122 that support a truss or frame 124. The frame 124 in turn supports a generally central housing 140. Mounted in one of the floats 122 is an air compressor or blower 172 (FIG. 1-2). The compressor 172 is driven by a motor 173 which is also supported in the float 122. The flotation members 122 are designed to ride at the surface "S" of a large body of water or other liquid in a basin or a lake. The compressor 172 is connected to and in communication with a flexible gas duct 177 which is in turn connected to and in communication with the upper end of an elongated downwardly extending rigid hollow center shaft 480. The shaft 480 extends through and is rotatably mounted on the central housing 140. The shaft 480 is rotated by a motor 196 mounted in the housing 140.

The center shaft 480 carries at its lower end, for common rotation a diffuser or discharge assembly 490 made up of a plurality of radially-extending hollow diffuser or discharge members or blades 484. The shaft 480 provides communication for gas flow from the compressor 172 to the interiors of the members 484.

The members 484 have upwardly facing porous diffuser surfaces 485 from which the gas is released as the members rotate, to both mix and aerate the body of liquid. The members 484 are relatively long for wide coverage and rotate at relatively slow, energy efficient rates.

The members 484 are constructed and arranged, as described more fully below, to provide an up-flow of gas that is dispersed generally uniformly transversely across the area spanned by rotation of the members.

The members 484 have their forward leading edges angled or tilted downwardly to compensate for the fluid lift pump effect of the rising gas as discussed above. The speed of rotation may be changed to provide the desired resultant angle of attack of zero (or slightly higher). This maximizes the shearing effect of the fluid flow as the members rotate. The illustrated discharger assembly 490 includes adjustment means that allows the manufacturer or the user to preset at a fixed angle the tilt or angle of incidence of the members 484 for different conditions. For a given basin, once the angle of incidence is set, the speed of rotation may be varied to achieve the desired angle of attack.

Further, the illustrated members 484 may be swept back between one and four degrees to provide a more stable rotating structure.

It is desirable that the user be able to selectively change the depth of the diffuser assembly 490 in the liquid body without stopping the operation of the apparatus to thereby control the rate of gas absorption. To this end, the vertical height of the illustrated center shaft 480 may be adjusted while the shaft continues to rotate and transmit torque.

The hollow shaft 480 may also enclose flexible lines 607 that may run from an admixture container or feed mechanism 606.

The apparatus 420 includes a pressure release arrangement 481 that automatically compensates for the depth of the diffuser assembly 490. In particular, a depending tubular extension 487 of the shaft 480 extends a predetermined fixed distance below the level of the members 484 to provide an outlet 481*a*. If the differential pressure in the members 484 exceeds a predetermined value, further increase in that differential pressure will be halted by release of gas through the outlet 481*a*. This prevents damage to the members by excess differential pressure without regard to the depth of the blades 484.

Fouling of the illustrated members 484 is controlled by the scouring action of the liquid as the members rotate. Fouling is further controlled by periodically lifting the blades 484 into contact with brushes 198 mounted on the underside of the frame, as shown in FIG. 1-2, and rotating the blades and/or directing a pressurized flow of liquid against the blades.

PREFERRED EMBODIMENT—MODEL 400 THE DIFFUSER ASSEMBLY SUPPORT AND OPERATING STRUCTURE

Referring more particularly to the drawings, FIGS. 1-1 through 1-3, it will be seen that there are three generally elongated cylindrically shaped floats 122. The illustrated support frame 124 may be made of steel or other strong, rigid material. The frame 124 includes the central generally rectangular housing 140 from which three elongated upright open frame portions 128 extend radially outwardly. In the floating configuration the frame portions 128 each have the general shape of a truncated triangle as viewed from the side. The three outwardly extending frame portions 128 are generally equally spaced from one another so as to be approximately 120 degrees apart from one another. Two of the frame portions 128*a* are single-width and each is supported at its outer end by one of the floats 122*a*. These two floats 122*a* are substantially smaller than the third float 122*b*. The larger third float 122*b* is connected to and supports the outer end of the third frame portion 128*b*. As shown best in FIG. 1-3, that third frame portion 128*b* is comprised of two side-by-side elongated frame sections 127 that extend parallel to one another and are connected by suitable cross-pieces. Supported in the larger float 122*b* is the air compressor 172 and the electric motor 173 which drives the compressor 172. The float 122*b* provides a silencing and a protective seal around the compressor and motor. An intake filter housing 174 is mounted on the float 122*b* and delivers air to the compressor 172. The compressor 172 then delivers pressurized gas to the sealed interior of the float 122*b* which operates as a silencer (FIG. 1-2). An outlet 176 from the float 122*b* communicates with the lower end of the flexible gas duct 177 that in turn communicates with the upper end of the central shaft 480.

More particularly, a rigid upright support structure 178 of steel or the like is mounted on the frame portion 128*b*. This support structure 178 supports the bottom part of the flexible or articulating duct 177 leading from the outlet 176 up about 20 feet. From there the flexible duct 177 extends upwardly and then arches back downwardly and radially inwardly to the center of the apparatus. There the duct 177 is connected by a gas-tight rotary seal 179 to the upper end of the hollow central shaft 480. This seal 179 permits the shaft 480 to rotate relative to the duct 177.

More particularly, as shown in FIG. 2-8, supporting the upper end of the shaft 480 is the bearing seal housing 704. Specifically, a thrust type bearing 660 mounted within the housing 704 supports a ring 661 which is rigidly mounted to the upper end of the shaft such that the shaft and ring may rotate together relative to the bearing housing while being vertically supported by the bearing seal housing. An annular rotary seal 662 is provided around the outside of the top end of the shaft 480, which allows relative rotation between the bearing seal housing 704 and the shaft 480 while preventing pressured gas from escaping from the interior of the shaft. An optional rotary union (not shown) may be located concentricity within the bearing seal housing for delivery of admixture as described below.

As described above in general terms, the hollow central drive shaft 480 is selectively vertically movable by the user between the lower submerged position showing in FIG. 1-1 and the raised, out-of-the-liquid position shown in FIG. 1-2, while the shaft continues to rotate.

To facilitate this motion, as shown best in FIG. 1-2*c*, the center shaft 480 extends through a vertically fixed but rotatably mounted upright generally cylindrical rigid metal sleeve 482. The sleeve 482 is rotatable held by a pair of thrust bearings 483 in the upper and lower walls of the housing 140. Male splines 489 on the shaft 480 engage female splines on the sleeve 482 so that the shaft will rotate with the sleeve, but can move vertically relative to it.

As seen best in 1-2*c*, 1-2*e*, the rotation of the drive shaft 480 is accomplished by means of a large sprocket 190 mounted on the sleeve 482 which engages a drive chain or belt 192. The drive chain 192 engages a smaller sprocket 194 that is driven by a motor 196 that is also mounted within the central housing 140. The user can selectively turn the motor 196 on and off and adjust its speed to control the speed of rotation of the sleeve 482, shaft 480 and the blades 484.

As shown best in 1-2, 1-2*a* and 1-2*b*, the vertical movement of the shaft 480 is achieved by a chain drive 180 between the shaft 480 and an upright rigid central support tower 182 of steel or the like mounted on the central housing 140. More particularly, the bearing seal housing 704 is secured to one strand of a chain 184 that extends vertically in a loop. The upper end of the loop of the chain 184 extends around and is engaged by a sprocket 185 rotatable mounted at the top of the support tower 182. The lower end of the loop of the chain 184 extends around and engages a drive sprocket 186 that is driven through a gear box 188 by a lifting motor 189 mounted on the support tower 182. The user selectively operates the motor 189 in a clockwise and counter clock wise direction to thereby raise and lower the shaft 480.

This vertical movement of the shaft 480 allows selective positioning of the diffuser assembly 490 at various depths within the body of liquid, or for it to be raised above the surface S of the liquid body as shown in FIG. 1-2 for purposes of start-up, repair, inspection, adjustment of blade angle, or draining of the basin et cetera.

As discussed more fully below, the blades must be elevated so that the discharge surfaces are out of (or only slightly below) the liquid surface when the compressor is started. Otherwise excessive pressure is exerted on the blades.

When the blades 484 are elevated as showing in FIG. 1-2, their upper discharge surfaces 485 may engage scrubbing brushes 198 mounted on the underside of the frame portion 128*b*. Rotation of the blades 484 in that elevated position will cause the brushes 198 to clean those surfaces 485.

The illustrated floating apparatus 420 may be held in position, laterally and against rotation, by suitable cables or tethers 125 extending between the frame 124 and/or floaters 122 and the sides and/or bottom of the basin as shown in FIG. 1-3.

Alternatively, the frame 124 may be rigidly supported from the walls of the basin as shown in FIGS. 1-3*a* and 1-3*b*.

MODEL 400—THE DIFFUSER ASSEMBLY

Referring to the drawings more particularly, FIG. 1-3 shows the spacial arrangement of the members 484. In the illustrated apparatus 420 there are twelve equally spaced-apart radially-extending members 484.

Figures 1A, 2:
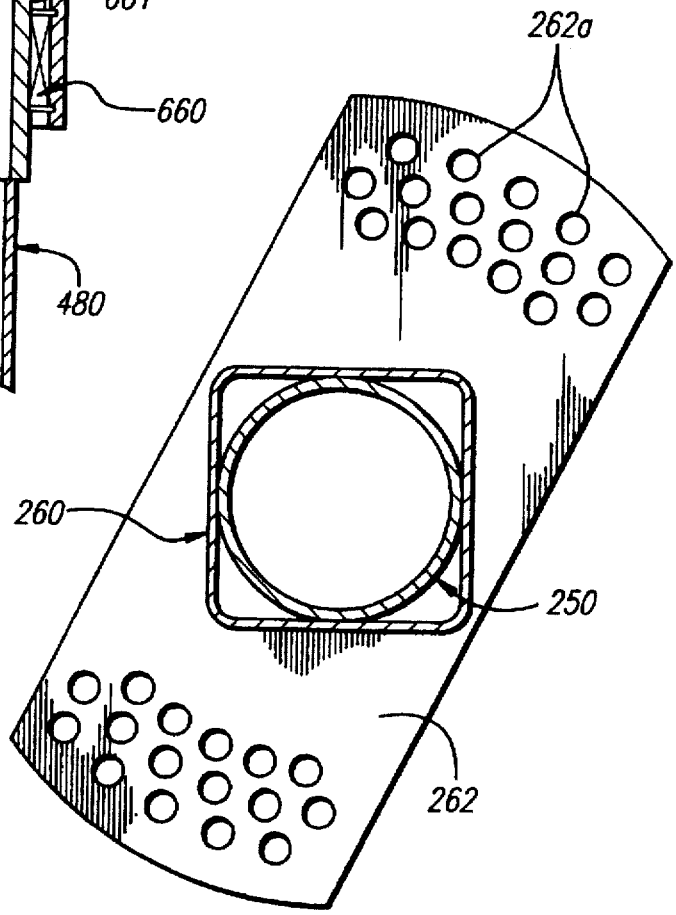
Figures 2, 3, 4, 5, 6, 7, 7A, 7B:
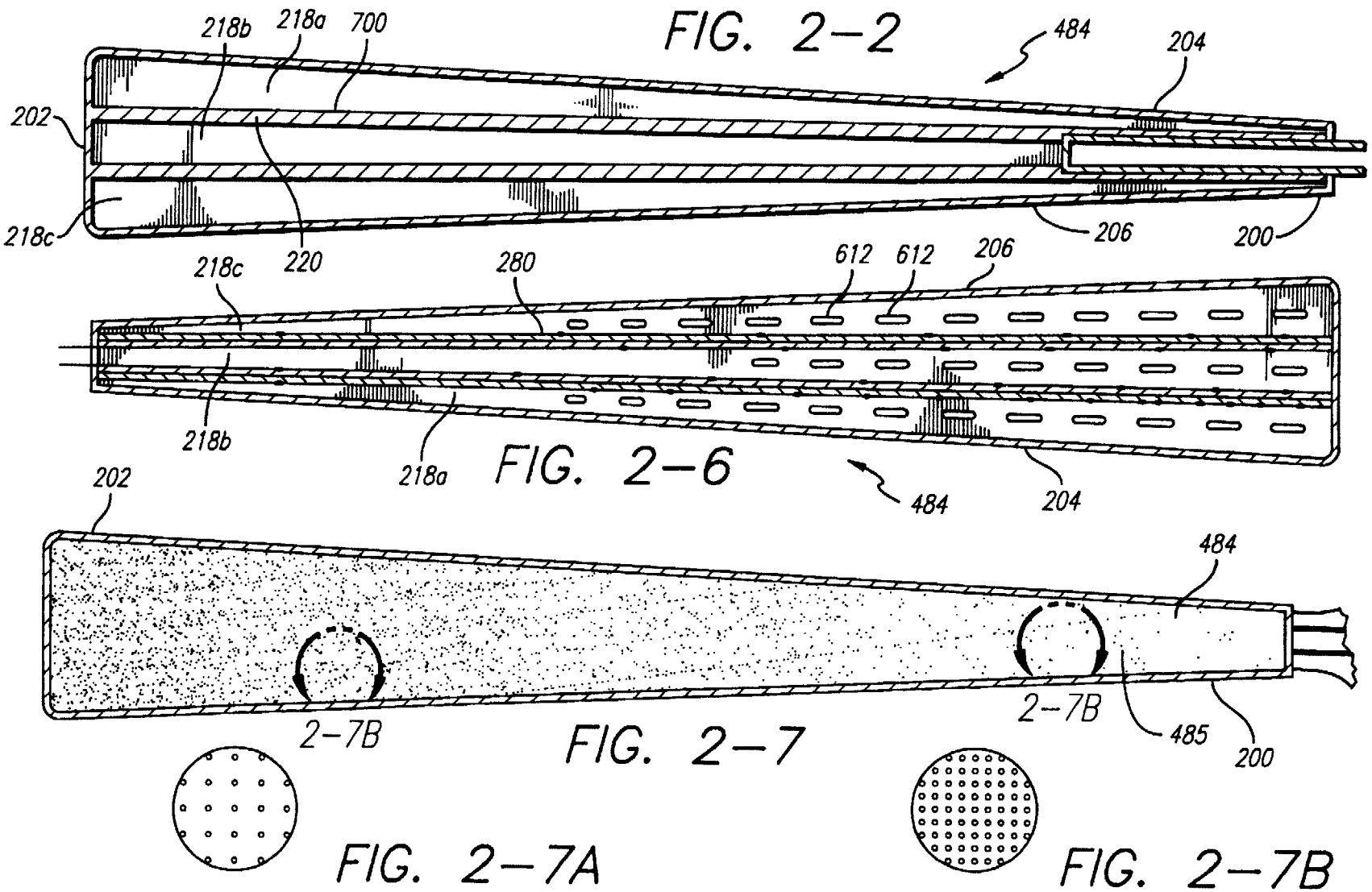
Figures 2, 3, 4:
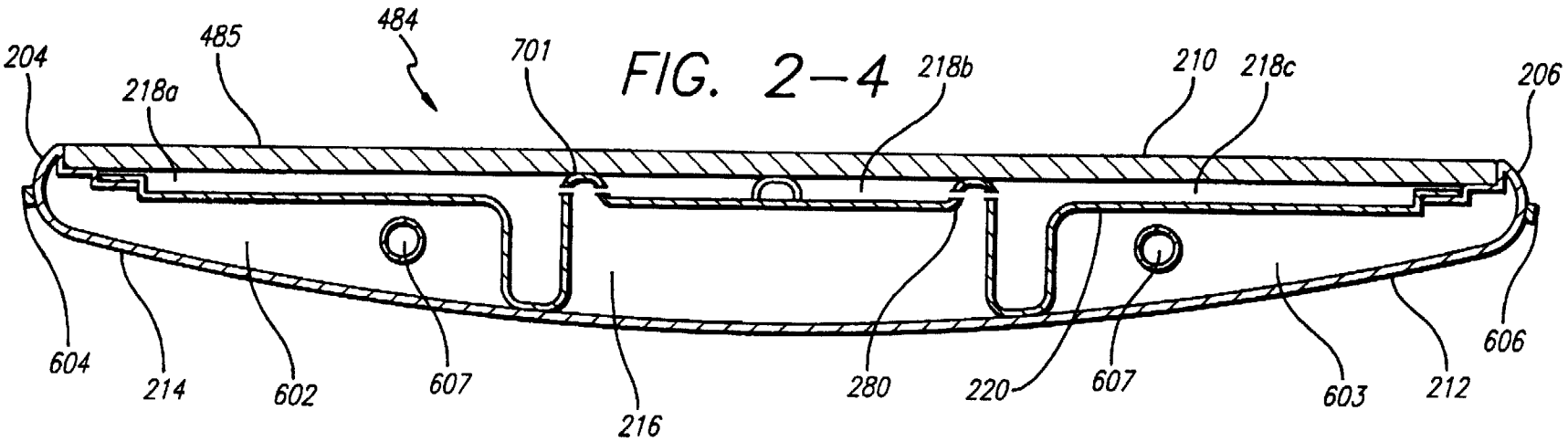
Figures 2, 3:
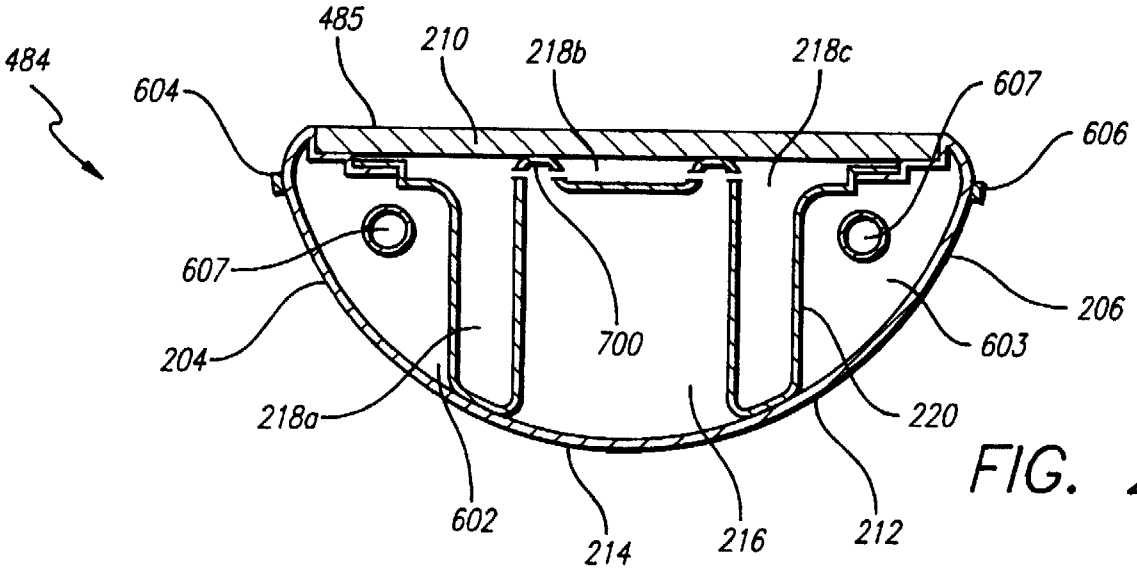
Figures 2, 3, 4, 4A:
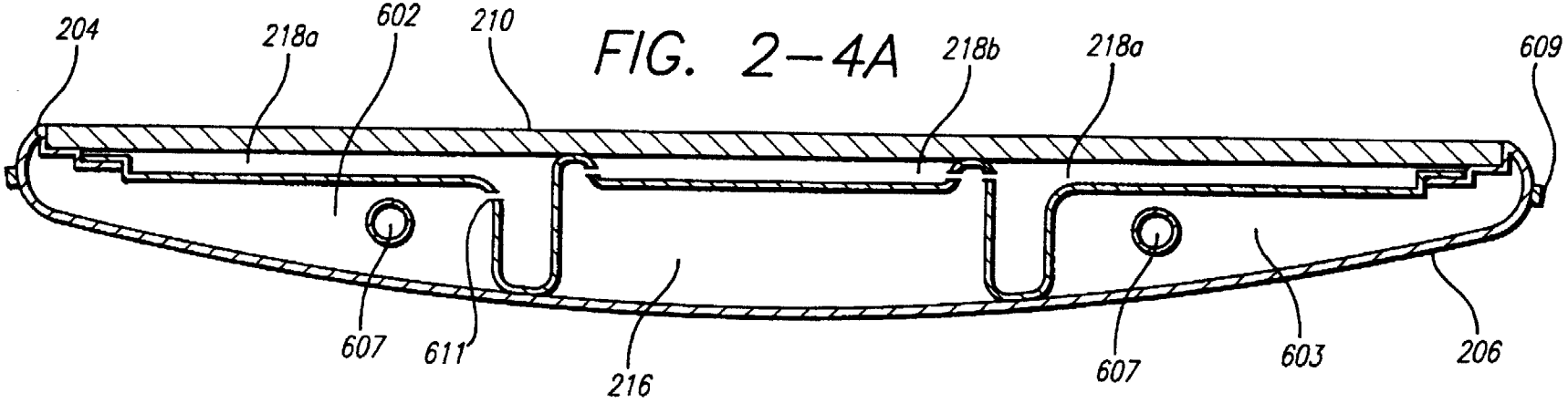
Figures 2, 3, 3A:
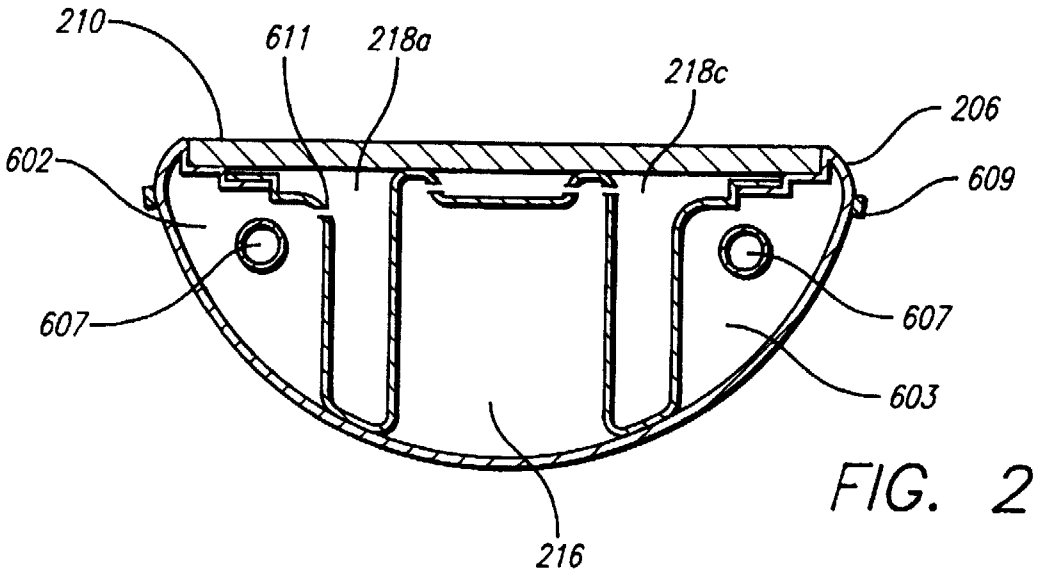
Figures 2, 3, 4, 5:
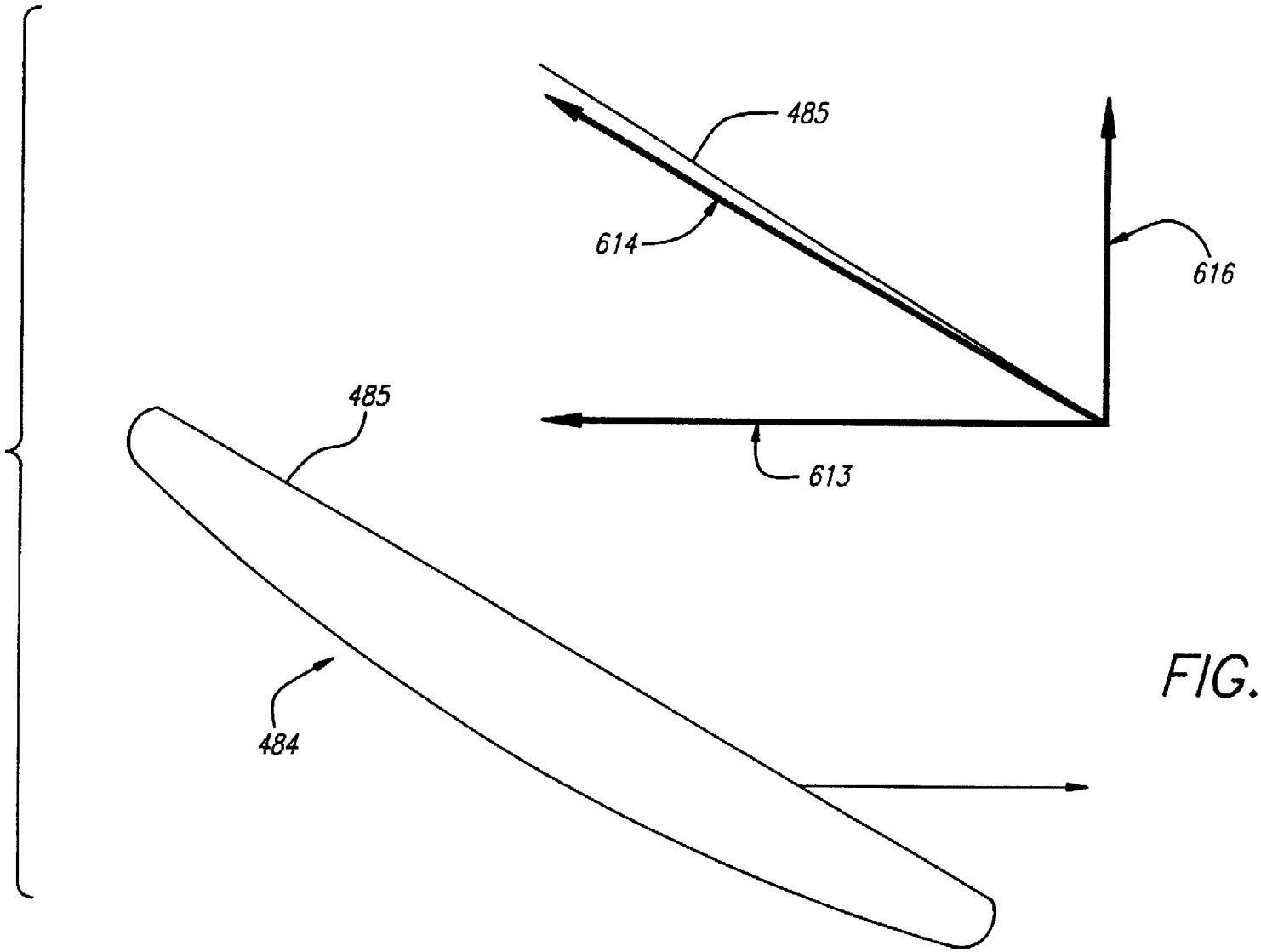
Figures 2, 3, 4, 5, 5A:
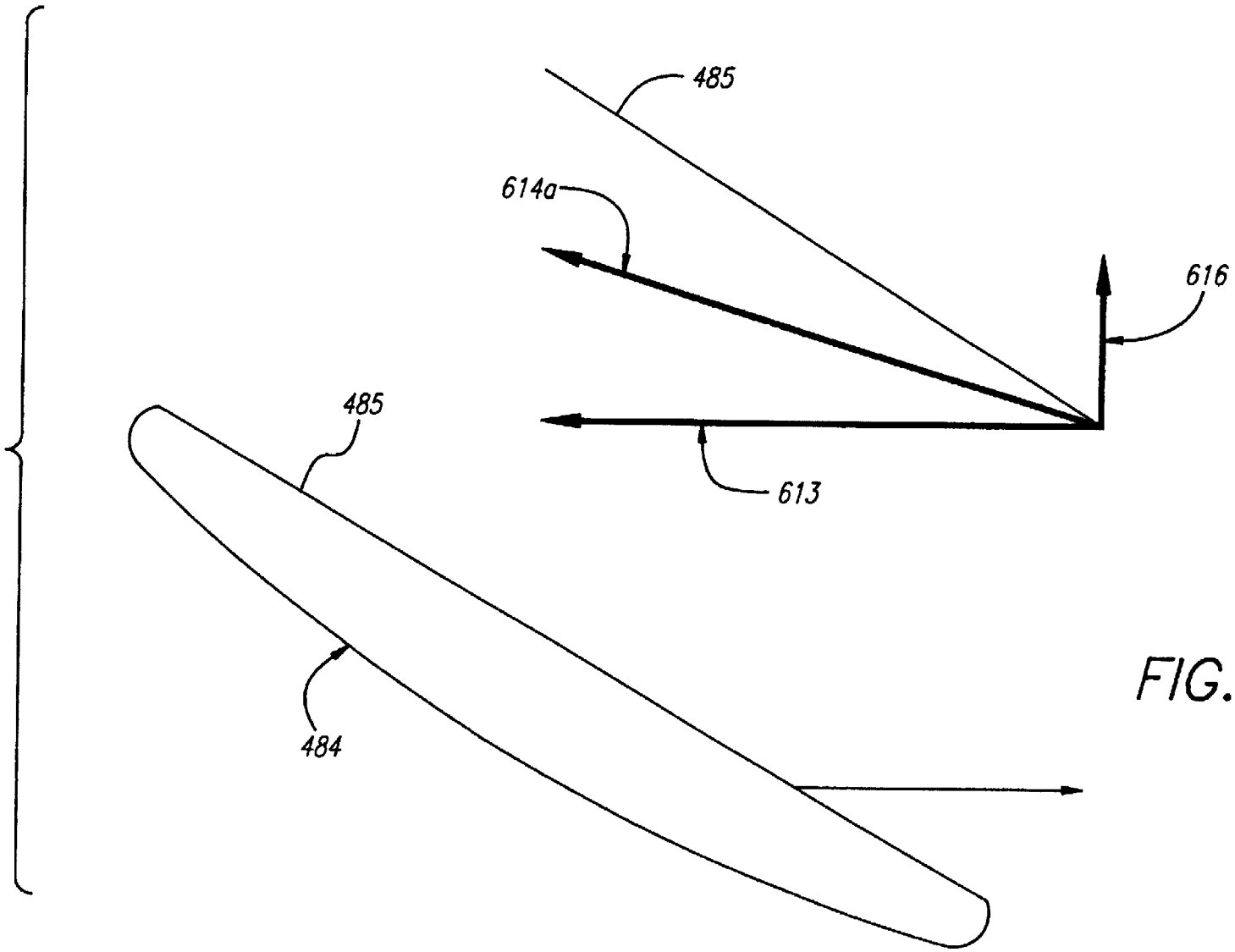
Figures 2, 3, 4, 5, 5B:
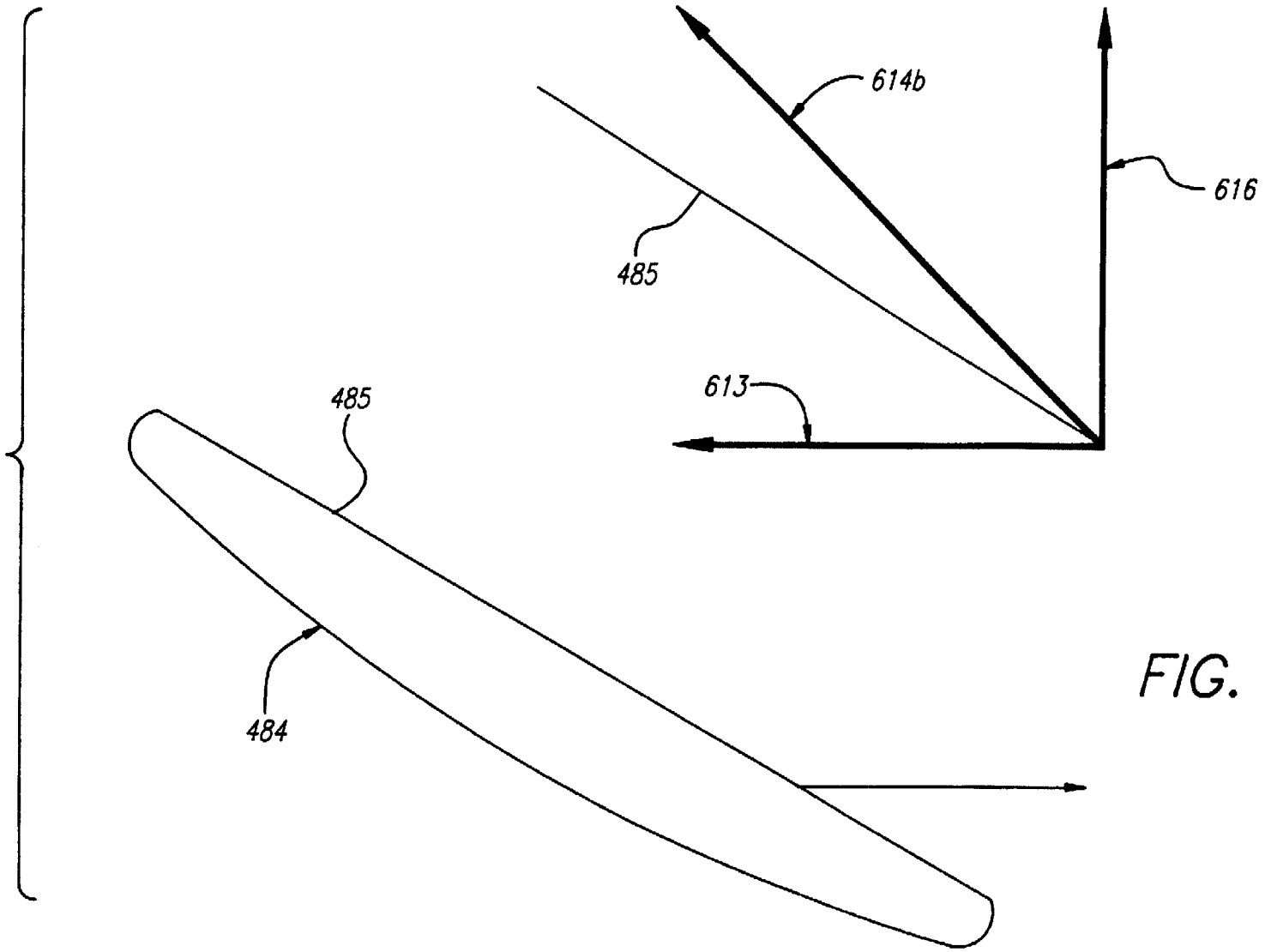
Figures 1, 3:
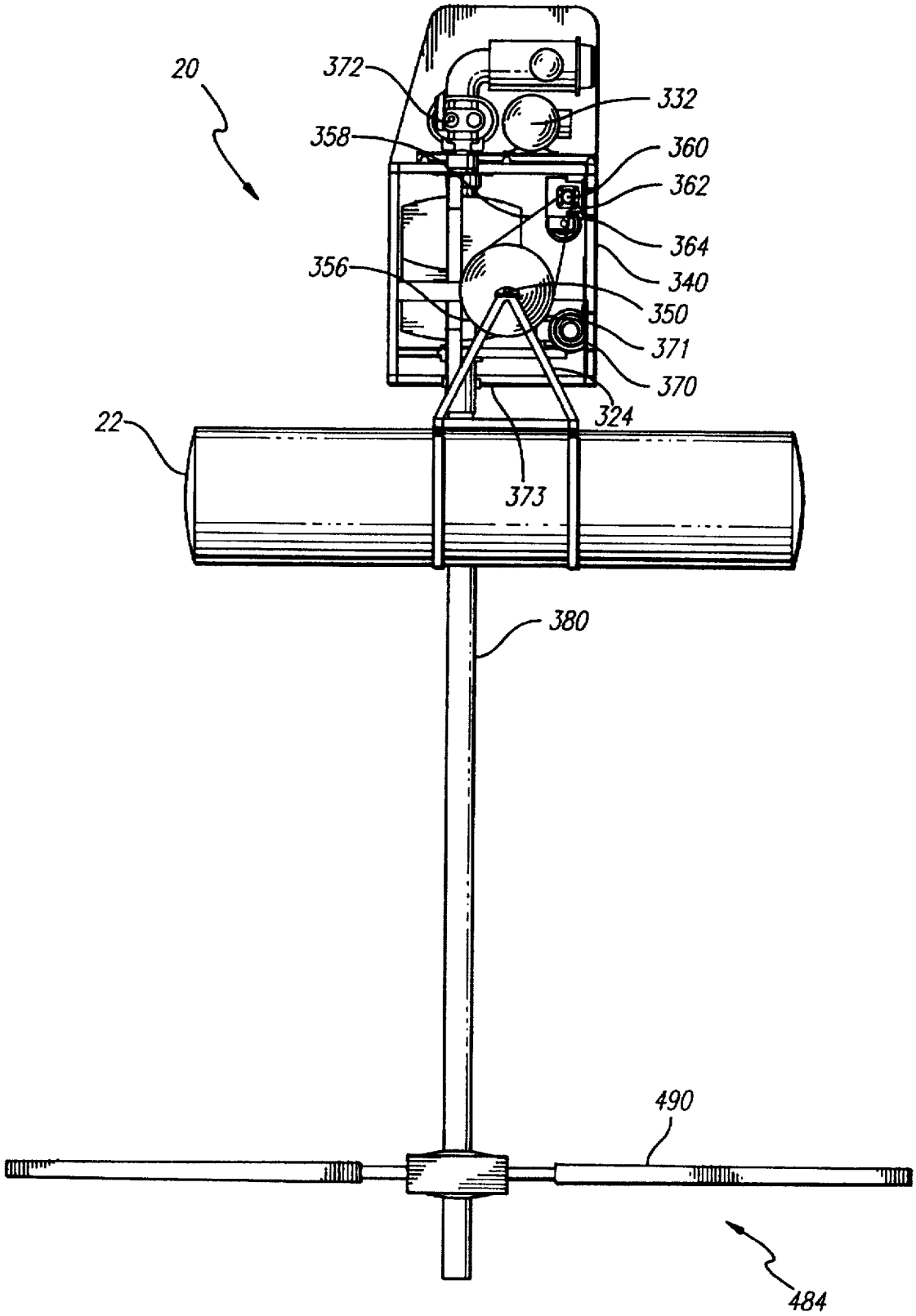
Figures 2, 3:
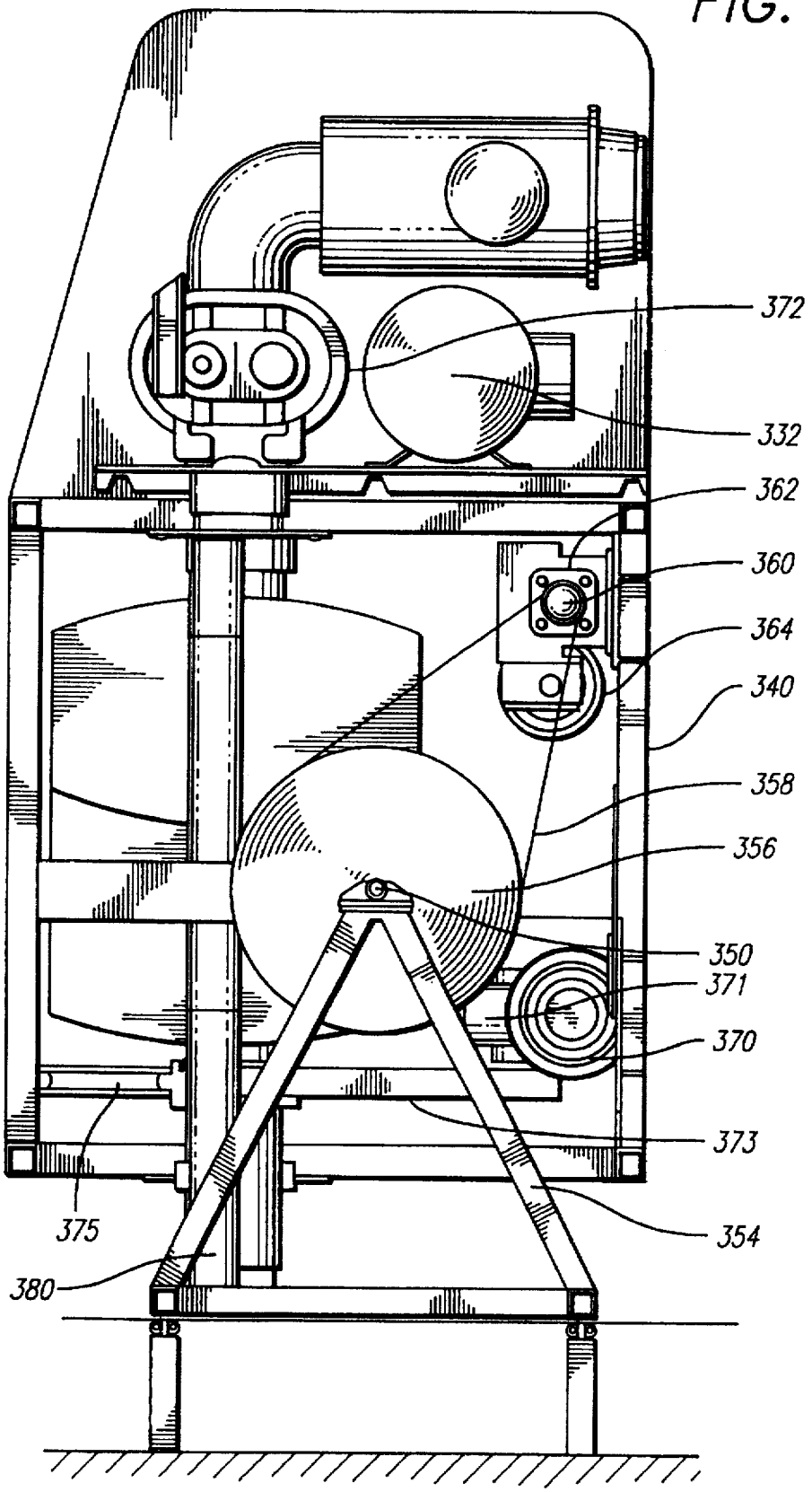
Figure 3:
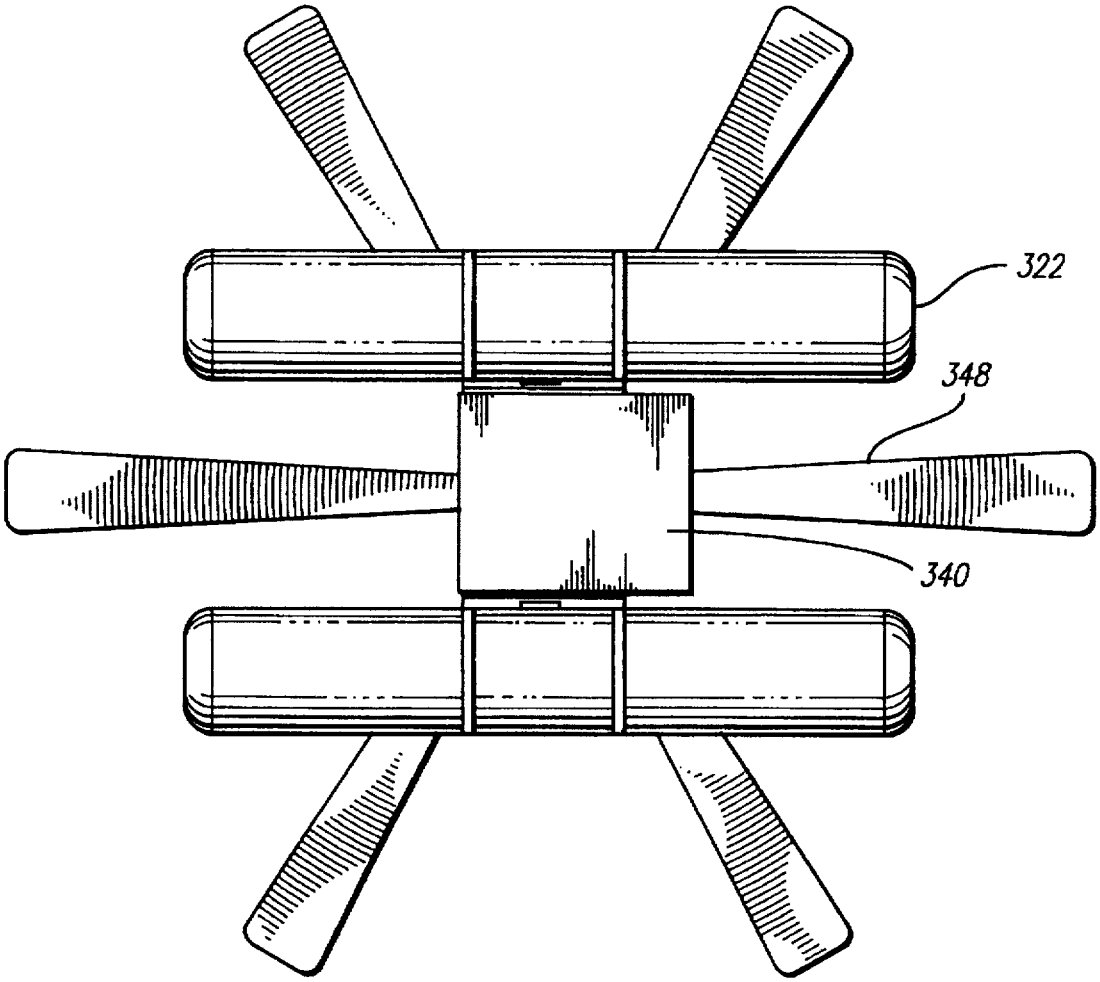
Figures 3, 4:
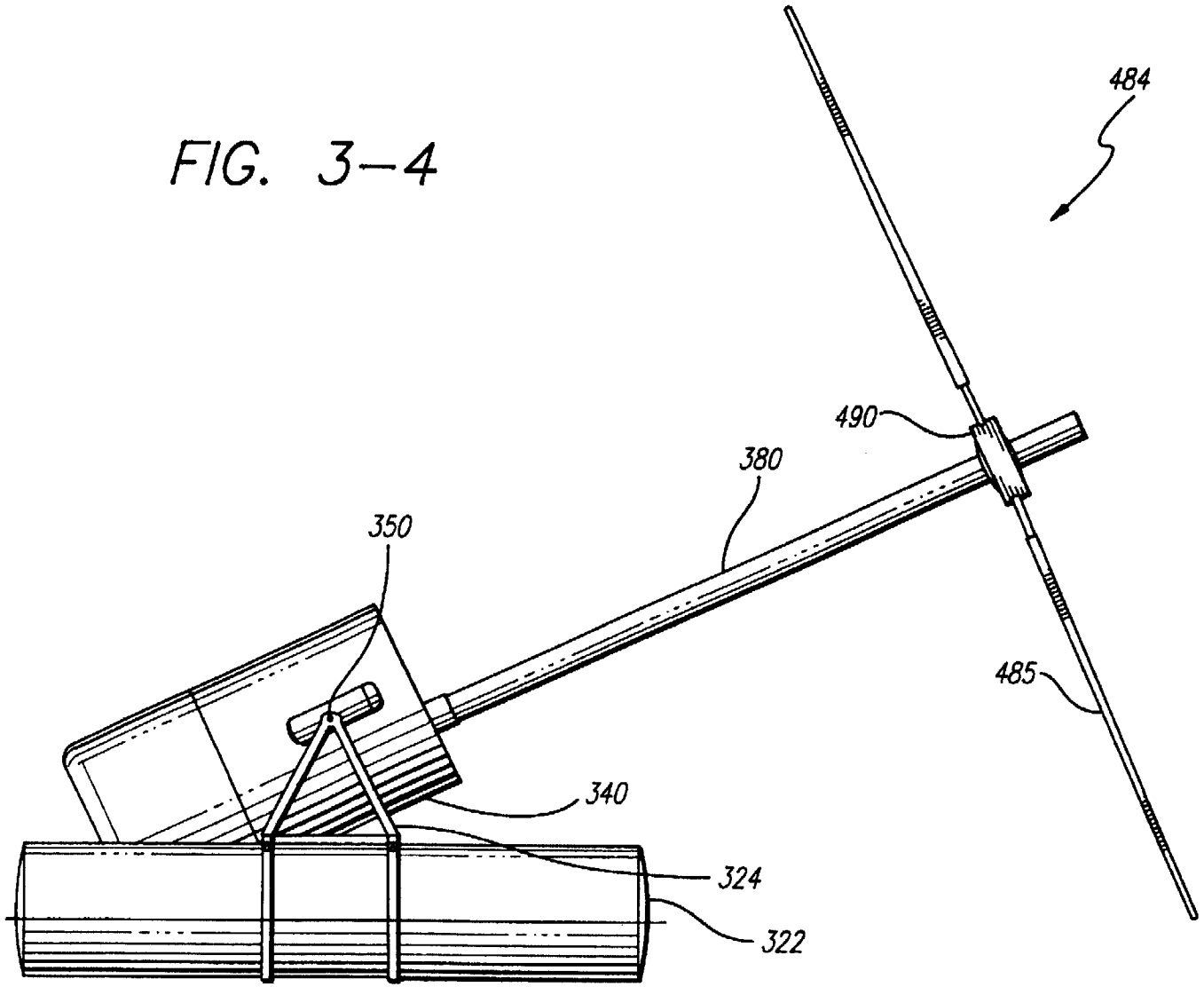
Figures 2, 4:
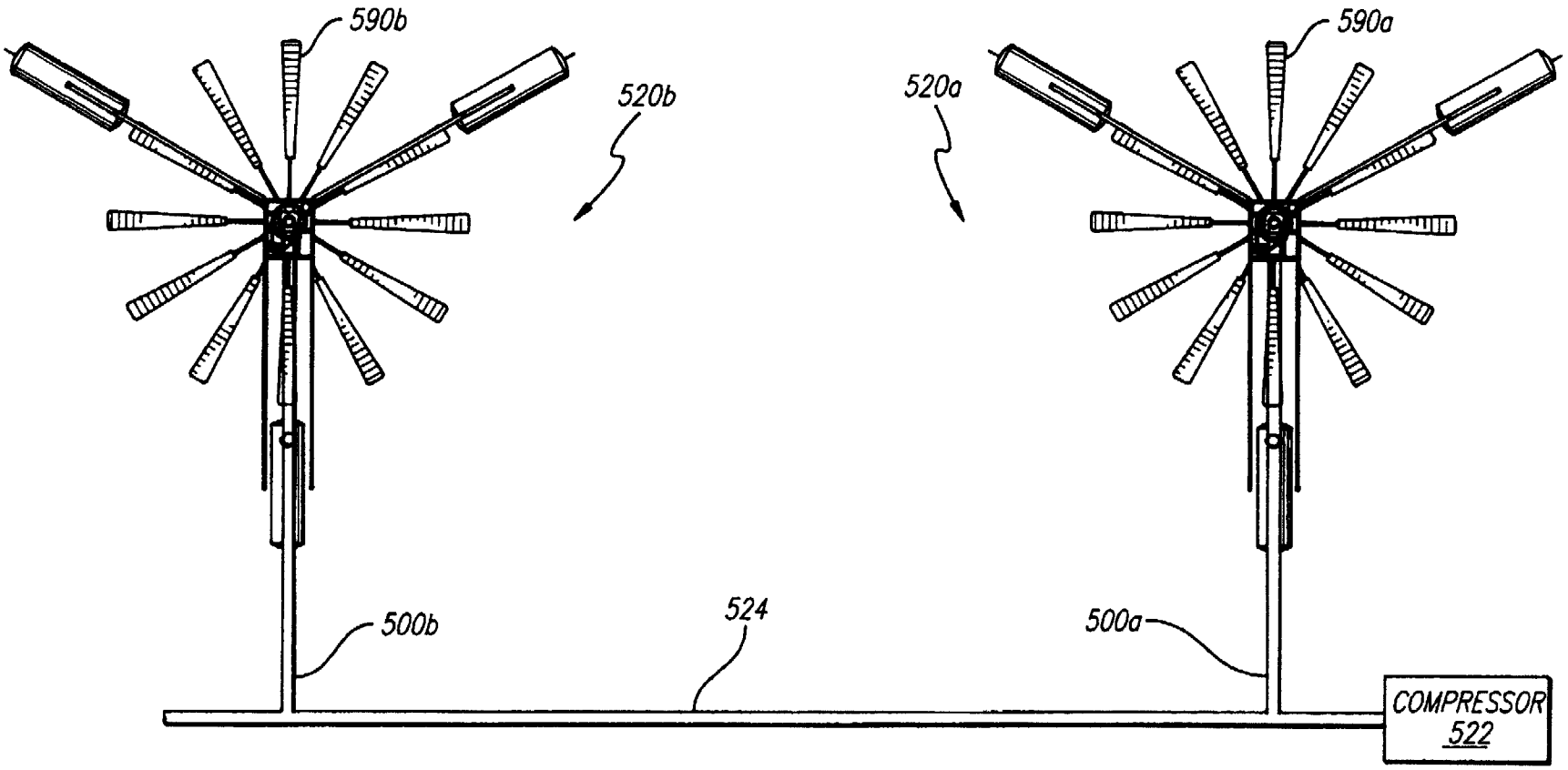

FIGS. 2-1, 2-1*a* and 2-2 illustrate the mounting of the blades or members 484 on the lower end of the main shaft 480. A generally cylindrical hub 230 is fixed to the lower end of the shaft 480 as by means of mating flange plates 232, 234, and bolts 236. The hub 230 has an outer wall 238 that is a generally upright cylinder fixed to the hub flange plate 234 via arcuate annular top and bottom wall structures 240, 242 which combine to form a chamber 244 within the hub 230. The chamber 244 is in communication with the interior of the shaft 480 through large openings 232*a*, 234*a* in the flange plates 232, 234. The chamber 244 is also in communication with the diffuser members via nipples 250, and with the liquid body via the opening 481*a* in pressure relief mechanism 481.

A plurality of generally horizontally extending sleeves or nipples 250 are fixed at their inner ends to the hub outer wall 238 and extend radially outwardly. The nipples 250 are spaced apart around the hub and each supports one of the members 484. The illustrated nipples 250 are hollow, generally circular, and communicate with the interior chamber 244 of the hub 230.

As shown in FIGS. 2-1 and 2-1*a*, each member 484 has a hollow, generally rectangular in cross-section mounting tube 260 for mounting the member on one of the nipples 250. The radially inner end of each tube 260 is telescoped over a nipple 250. Each tube 260 is provided at its radially inner end with a transverse mounting flange 262 that may be locked to the hub wall 238 adjacent to the associated nipple 250 as by means of bolts 264 and nuts 226. Located between the mounting flange 262 and the hub wall 238 and surrounding the nipple 250 is an o-ring type seal 610. The tube 260 and its member 484 are thus locked in a fixed position relative to the shaft 480. The radially outer end of each tube 260 is fixed by suitable means to the radially inner end 200 of its member.

A flange 262 may be selectively rotated about its axis relative to the hub side wall 238 to place its associated blade 484 at a desired tilt angle and then locked in that position. This selective positioning is achieved by providing each flange 262 with a plurality of mounting holes 262*a* for the bolts 264 (FIG.2-1*a*). This allows the angle of the incidence of the blades to be selectively fixed by the manufacturer or use at different angles for different conditions (such as speed of rotation, volume and rate of air discharged, viscosity of the liquid).

FIG. 2-2 is a view of one of the members from the top with the diffuser material removed. Each member 484, as viewed from the top, is generally trapezoidal, being tapered from a narrower radially inner end 200 to a wider radially outer end 202. This trapezoidal configuration contributes, as noted generally above, to the ability of the rotating members to provide a more uniformly distributed supply of gas across the reactor column footprint by providing more gas at their radially outer portions than at their radially inner portions. Each member 484 has a leading edge 204 and a trailing edge 206.

FIG. 2-3 is a cross-section of one of the members 484 taken adjacent to its radially inner end 200 near the shaft 480. At this point, the cross-section of the illustrated member 484 is generally elliptical and symmetrical. Its upper discharge surface 485 is generally flat and provided by a flat upper wall or plate 210 of porous material such as scintered plastic, perforated rubber-like material, or the like. Its lower surface 212, which is curved and almost semi-circular, is provided by a solid lower wall 214. Wall 214 may be made of a relatively strong, durable and liquid-impervious but light-weight material such as fibre glass or various plastic compositions. The interior structure of the members 484 may be made of the same or a like material to that of wall 214.

FIG. 2-4 is a cross-section of the member 484 taken generally adjacent the radially outer end or the tip 202 of the member. At this point, the cross-section is wider and thinner than at the shaft as shown in FIG. 2-3. It still has the flat upper surface 485 provided by the porous plate 210 and the curved lower wall 214. However, the lower wall 214 and the lower surface 212 has a longer radius than at the radially inner end. The thick radially inner section provides the required strength and the thinner radially outer section reduces drag.

The exterior cross-section of the member 484 generally progresses from the rounder, narrower width at the shaft (FIG. 2-3), to the more flattened, thinner and wider configuration at the tip (FIG. 2-4).

A liquid impervious intermediate wall 220 extends the length of the member and combines with the outer wall 214 to form interior chambers or inferior plena.

The intermediate wall 220 may be configured to form one or more support or reinforcing structures which extend the full length from the radially inner end to the radially outer end to strengthen the blades.

In particular the intermediate and outer walls 220, 214 form an inferior central plenum, which provides the air or gas supply duct 216 that extends radially down the center of the member 484, and a pair of lateral inferior plena or chambers 602, 603 that extend respectively along the trailing and leading edges of the member.

The inferior central gas plenum 216 communicates, as described more fully below, with the interior of the central shaft 480.

The porous plate 210 is attached to and sealed against an upward convolution 221 in the intermediate interior wall 220 to define two or more elongated gas distribution superior plena 218*a*, 218*b*, 218*c* that extend radially the length of the member and are arranged generally parallel to one another from leading to trailing edge across the width of the member. In the embodiment shown in FIG. 2-3 and 2-4, these three superior gas plena 218*a*, 218*b* and 218*c* receive gas from the central inferior gas supply plenum 216 through suitable ports 280 in the intermediate wall 220. The gas then flows from the three superior gas plena 218*a*, 218*b*, 218*c* through the porous plate 210 into the body of liquid. As noted above and described more fully below, the three superior gas plenum tend to equalize gas discharge across the width of the members.

FIG. 2-6 is a view of a diffuser member 484 with the diffuser material 210 removed and showing the ports 280 between the central inferior plenum 216 and the superior plena 218*a*, 218*b*, 218*c*. This porting pattern allows gas to flow into the leading superior plenum 218*a* without restriction, into the central superior plenum 218*b* with some restriction, and into the trailing superior plenum 218*c* with increased restriction. The gas flow rates from each of the superior plena which experience different static head pressure, are thereby equalized. Shown in FIG. 2-6 are the support bosses 612 that are attached to the underside of the porous diffuser material 210 to decrease the unsupported span length between supporting portions of the superior plena wall 220 to maintain a generally flat diffuser surface.

As shown in FIGS. 2-3 and 2-4, the discharge member 484, the lateral inferior plena or chambers 602 and 603 each communicate through one of the admixture ducts 607 that extends up through the shaft 480 to a rotary seal (not shown) and thereafter through a nonrotating duct to a suitable supply means or the additive or admixture supply container 606 (FIG. 1-2). Additive may be dispensed from the plenum 602, 603 through a number of discharge jets or nozzles 609 arrayed along the leading and trailing edges 204, 206. The number and size of the discharge nozzles 609 on the leading and trailing edges are progressively greater in number and/or size as they progress from the diffuser hub to the tip of the blades. This provides more even distribution of the admix flow across the circular area defined by the rotating blades, and reduces the tendency for there to be more admixture released closer to the center of rotation and for the bubble size to therefor be larger.

As shown in FIGS. 2-3*a* and 2-4*a*, an admixture may also be diffused from one or more of the superior plena 218 in lieu of the primary gas. For example, the superior plenum 218*a* would not be ported or in communication with the central inferior plenum 216, but would be in communication with the admixture supply duct 607 via ports 611. Liquid or gas from the admixture supply system would enter the plenum 218*a* and escape through the porous plate 210 above the plenum. Such diffused admixture injection arrangement is different from the admixture injection by jets 609 in terms of admixture distribution patterns and physical characteristics, such as bubble size of the admixture material. This diffused admixture injection system provides the advantages of shearing of the admixture as it emerges from the porous plate 210, maintaining separation of the admixture from the primary gas until they are both present in the liquid body, and providing close proximity of the primary gas and the diffused admixture material in the liquid.

As shown in FIG. 2-3*a* and 2-4*a*, the nozzles or jets 609, which are provided at only the trailing edge 206 in that embodiment, generate a reactionary force from the admixture discharge. This reactionary force will supply rotational force to rotate the diffuser assembly or assist in the rotation of the diffuser assembly. Further, a net reactionary force could be provided by more and/or larger jets at the trailing edge 206 relative to jets at the leading edge 204 (not shown).

As noted above, the members or blades 484 are inclined, with their leading edges 204 lower than their trailing edges 206 to facilitate operating at a zero or slightly positive angle of attack. As also noted above, this incline tends to create a differential in static head pressure i.e., higher head pressure at the leading edge and lower head pressure at the trailing edge. Since the gas prefers to escape from where there is less static head pressure, progressively more gas would tend to flow from the trailing edge. This would undesirably produce larger gas bubbles. In the illustrated diffuser assembly 490 this is compensated for by providing gas at a progressively higher pressure toward the leading edge relative to the trailing edge. More particularly, gas under greater pressure is provided to leading superior plenum 218*a*, gas under less pressure is provided to the central superior plenum 218*b*, and gas under relatively less pressure is provided to the superior trailing plenum 218*c*. This results in a more uniform gas flow across the width of the pitched blades.

As will be described in more detail below, the configuration of interior of the members 484 causes the gas to pass from the central inferior plenum 216 generally horizontally into the superior plenum 218*a*, 218*b*, 218*c*, generally parallel to the underside of the plate 210.

As also noted above, it is desirable to release more gas as you progress toward the tips of the diffuser blades 484. In the illustrated diffuser members 484, each porous upper plate 210 progressively widens as you progress from center to outer tip of a member. The illustrated plate 210 is uniform throughout as to size and dispersion of its perforations. In other words, there are a generally uniform number of perforations per unit surface area. Thus, the greater the surface area, the more perforations. Thus, as the plate 210 widens toward the member tip, the number of perforations and the amount of gas discharged also tends to increase toward the member tip.

As shown in FIG. 2-7, in an alternative embodiment of the member 484, an alternative porous plate media might be used, as for example a rubber sheet or membrane with selectively punched holes. Such holes could be made of different sizes, and/or of different quantity per unit surface area, to control the amount of gas released at various locations on the member 484. Accordingly, the transverse distribution of holes across the width in the diffuser blade may be varied to compensate for the static headpressure differential caused by the angle of incidence of the diffuser blade. In particular the area adjacent to the lower leading edge 204 may have an increased number and or size of holes per unit of surface area. The size and number of holes adjacent to the elevated lagging edge 206 of the blade may be smaller and fewer in number of holes per unit of surface area. The objective of the foregoing is to equalize gas flow over the width of the pitched diffuser blades.

Similarly, as shown in FIG. 2-7, the size and or number of holes per unit area can also be increased as you progress radially outwardly toward the tip of the blades to provide more uniform gas flow over the area traversed by the rotating blades or the footprint of the reactor column. FIG. 2-7*a* shows a larger number of holes per unit area adjacent to the radially outer end 202 of a blade. FIG. 2-7*b* shows a smaller number of holes per unit area adjacent to the radially inner end 200 of a blade.

The perforations or holes 701 in the porous plates 210 allow gas within the interior of the superior plena of the members 484 to pass outwardly into the liquid body. As the members 484 rotate, the gas emerging from the perforations is sheared by the relative motion of the diffuser material and the adjacent liquid. Bubbles emitted by the moving porous plate are substantially smaller in size than the size of bubbles that would emerge from the perforations if the members were stationary. This is highly desirable since, as noted above, the same amount of discharged gas in the form of smaller bubbles provides greater surface area for dispersion of the gas into the liquid body than does the same amount of gas in the form of larger size bubbles. As a result, for a given amount of discharged gas, more gas is dissolved into the liquid.

As described above, the illustrated members 484 are tilted with their leading ends 204 below the trailing ends 206. Applicant has built and tested a prototype of apparatus 480 and has found that a tilt angle of between about 5 degrees and about 35 degrees provides highly efficient operation of the apparatus. As discussed above, this angling or tilting of the members achieves highly efficient shearing of the emerging gas by virtue of a resultant angle of attack of zero or slightly greater.

The angle of incidence of the blades may be selectively fixed by the manufacturer or the user for different situations and conditions (such as approximate desired speed of rotation, basin geometry, fluid viscosity, gas flow rate, etc.) to achieve the desired resultant angle of attack of zero or greater.

While it is desired to achieve an angle of attack of zero or slightly positive, it is also desired to achieve this for different and changing conditions (such as varying liquid viscosity's, air flow rates and liquid patterns) without having to adjust the angle of incidence of the blades. This can be done by varying the speed of rotation of the blades. The user can determine and maintain such optimum speed of rotation by observing torque usage and appropriately adjusting the speed of rotation of the diffuser means to achieve the desired torque.

More particularly, as the angle of attack becomes significantly greater than zero, as indicated in the vector diagram of FIG. 5-2*a*, the power required to rotate the blades increases. Such power increase, if not controlled, could over-stress the blades and the drive mechanism and waste energy.

FIG. 2-9 illustrates, in block diagram form, monitor and control means 800 of the apparatus 420. The illustrated means 800 operates to automatically adjust the rotation speed to maintain the desired angle of attack. A monitor and control computer or programmed microchip 802 receives data from a torque sensor 804 that monitors the torque being applied to the rotating diffuser blades 484. For a given speed of rotation and angle of incidence, this torque has a direct relationship or ratio with the upward forces applied to the blades by the "lift pump" affect. When the torque exceeds a predetermined upper value or set point, the computer 802 sends a signal to the variable speed drive 806 to decrease the speed of the shaft rotation motor 196. When the torque falls below a predetermined lower value or set point, a signal is sent to increase the speed of the motor 196.

Thus, the angle of attack may in that way be automatically maintained between setpoints of zero to slightly positive.

The apparatus 420 may include a control panel (not shown) for controlling the monitor and control means 800. Means 800 may also control the compressor motor 173 (on or off) and the lifting motor 189.

As noted above, various data may be collected by a monitor or sensor 808 which provides the results to the monitor and control computer 802. The computer 802 in turn controls the lifting motor 189 to change the depth of submersion of the discharge means 490 to provide a desired rate of infusion of the gas into the liquid as dictated by the input data.

By way of example, the apparatus may be installed in a basin which receives liquid containing biomass. During the treatment process, microorganisms in the liquid consume the biomass as a food source—thus removing the biomass from the liquid. As a result of the microorganisms consuming the biomass, the dissolved oxygen concentration in the liquid is reduced. This reduction in dissolved oxygen concentration is detected by a dissolved oxygen sensor 808.

The dissolved oxygen sensor 808 sends data to the monitor and control computer 802. The signal may be in the form of a 0–10 volt or 4–20 milliamp signal which indicates the dissolved oxygen level in the basin. The monitor and control computer 802 then compares the dissolved oxygen level from the sensor 808 to a desired predetermined value. Should the dissolved oxygen concentration in the basin fall below the desired value, the monitor and control computer 802 will automatically cause the lifting motor 189 to increase the submergence level of the discharge means 490. The result of this increase in submergence level is an increase in dissolved oxygen production. Conversely, should the dissolved oxygen concentration rise above a desired value, the monitor and control computer will automatically cause the lifting motor to decrease the submergence level.

The diffuser assembly 490 may also be operated without gas for purposes of effecting mixing and/or admixture release. When so operated there is no lift pump effect. In such case the speed of rotation must be reduced to prevent over stressing the blades or drive mechanism.

MODEL 400—PROTOTYPE

In a prototype for this embodiment model, fourteen discharge members were used. Each member had a length of about ten feet, a width at the tip of about 16 inches and a width at the base of about 6 inches. The height of the member at the base was about 2 inches and the height of the member at the tip was about 1.25 inches. As noted above, tilt angles were between about 5 degrees and about 35 degrees. The members were rotated at speeds of from about 3.5 rpm to about 15 rpm. The gas was provided at a pressure of about 1 psi to about 15 psi. The surface speed of the members at 3.5 RPM varied from about 220 feet per minute at the tip to about 44 feet per minute at adjacent to the base. The surface speed of the members at 15 RPM varied from about 950 feet per minute at the tip to about 188 feet per minute adjacent to the base. The size of the perforations in the porous walls were about 30 Microns. The members were maintained at a depth ranging between zero and 20 feet in the liquid body. A pressure differential of approximately 0.5 to 1.5 PSI was maintained between the interior and exterior of the members.

MODEL 400—SELF ADAPTING PRESSURE RELIEF ARRANGEMENT

The illustrated apparatus 420 includes the self-adjusting pressure release or relief arrangement 481. In general this arrangement includes a semi-rigid tubular section or extension 487 of the main shaft 480 that extends a predetermined distance below the diffuser members 484 to an outlet 481*a* at the lower end of that extension 487. A check-type valve 487*a*, may be positioned in the extension 487 to prevent the introduction of liquid from the basin up into the interior of the blades. The relief arrangement 481 is designed such that it requires a predetermined pressure differential to open. The pressure required to release gas from the outlet 481*a* is equal to the sum of (1) the pressure in inches of liquid column from the diffuser surface 485 to the opening 481*a*, plus (2) the pressure required to open the check valve 487*a*.

As the apparatus 420 operates there is a pressure differential between the compressed gas within the members and the pressure of the water outside of the members. The pressure of the gas is normally greater, which allows the discharge of the gas through the perforations into the liquid body. This pressure differential was about 0.5 to about 1.5 psi in the prototype.

More particularly, the illustrated extension 487 extends about 25 inches below the level of the diffuser members 484. In this arrangement, if the differential pressure of the compressed gas in the members and the static head pressure of liquid above the member is less than the sum of (1) the length of the tubular extension 487, plus (2) the pressure differential required to open the check valve 487*a*, the compressed gas will not force water out of the lower end outlet 481*a*. For example, if the differential between the compressed gas in the members and the exterior water pressure is 12 inches, the compressed gas will force itself down the tubular extension 487 only an additional 12 inches below the level of the members and gas will not flow out of the outlet 481*a*. Should the pressure differential in the members exceed or attempt to exceed the predetermined value, the gas column will force itself down to and past the lower end outlet 481*a* and gas will be discharged out of that outlet to relieve such excess pressure. This avoids damage to the members from pressure in excess of the predetermined amount.

This arrangement is automatically compensates for depth of submergence of the diffuser members 484 in that the gas pressure will be relieved whenever the differential pressure in the members 484, measured in inches of liquid column, exceeds the sum of (1) the length in inches of the tubular extension 487, plus (2) the pressure required to open the check valve 487*a*, regardless at what depth the members are disposed in the liquid body. This automatic depth compensation avoids having to adjust a safety or a release valve for each time the blades are positioned at a different depth. The pressure relief arrangement is attached to and moves vertically with the diffuser assembly. The pressure relief arrangement and diffuser assembly are therefore subjected to the same relative static head pressure. The pressure relief arrangement need only be set one time for the desired maximum pressure differential (by setting the length of the tubular extension 487 and the opening force of the valve 487*a*).

DETAILED DESCRIPTION OF THE DRAWINGS—MODEL 500

FIG. 4-1 illustrates an alternative embodiment 520 of the invention which is essentially like apparatus 420 except that: (a) it lacks a compressor; (b) it lacks a motor to drive the compressor; and (c) it has a connector between the flexible gas duct 177 and a duct 500 from a remote source of compressed gas.

FIG. 4-2 illustrates a system that includes two of the apparatus 520*a* and 520*b* which both are connected to and received compressed gas from a single remote source such as a constant pressure or constant volume compressor 522. FIG. 4-2 illustrates a common supply line 524 and individual feeder lines 500*a*, 500*b* to each apparatus 520*a*, 520*b*. Additional separate apparatus 520 (not shown) may be connected to and supplied with gas by the compressor 522 and the line 524 as desired. A control unit (not shown) may be connected to the lift motors 589 of the apparatus 520*a*, 520*b* and may operate to coordinate the relative level of submergence of the discharge assemblies 590*a*, 590*b* of the apparatus 520*a*, 520*b* to thereby selectively determine which diffuser assemblies 590*a*, 590*b* discharge proportionally more or less gas.

By decreasing the relative diffuser submergence level (and therefor decreasing the relative static head pressure) of one discharge assembly 590*a* relative to the other assembly 590*b*, flow to assembly 590*a* with less submergence increases and flow to assembly 590*b* with more submerged decreases.

Total power consumption and dissolved gas production of all apparatus connected to the common gas source 522 may be varied by collectively increasing or decreasing the submergence level of all of the apparatus. The collective increase or decrease of all apparatus may be viewed as the same as one compressor and one apparatus in contrast to the relative increase or decrease in submergence level of multiple apparatus connected to a common gas source.

This may be viewed as an improved proportional gas flow control mechanism (valve) which is capable of automatically and selectively increasing or decreasing relative gas flow to multiple apparatus receiving gas from a common gas source.

There are several reasons why it is desirable to control the relative flow to multiple apparatus or units connected to a common gas source.

1) Multiple sensors located in a facility (ie, one or more basins) may detect the need for increased gas in one part of the facility relative to another. The monitor and control computer, which receives data from these sensors, detects this need and increases gas flow to that part of the facility by decreasing the relative submergence level of the units in that area relative to the other units attached to a common gas source.

2) Certain treatment process require alternating periods of gas flow with mixing followed by periods with no gas flow and mixing only. By varying the relative depths of multiple units attached to a common gas source, gas flow to individual units may be reduced or eliminated, thereby creating zones of mixing only and of mixing with gas release.

3) Enhanced mixing patterns and energy distribution may be obtained with increased gas flow rates, however, dissolved gas requirements or existing compressor/piping facilities may not allow increased gas flow rates to all parts of the facility simultaneously. By alternating the zones of high gas flow rates the benefits of enhanced mixing patterns and energy distribution may be realized while not exceeding total dissolved gas production requirements and not exceeding the compressor and piping capacities.

DETAILED DESCRIPTION OF THE DRAWINGS—MODEL 300

FIGS. 3-1 through 3-4 illustrate a second presently preferred alternative embodiment 320 of the invention. This apparatus 320 comprises a pair of elongated hollow flotation members 322 that support a frame 324. The flotation members 322 are disposed generally parallel and spaced apart from one another. The frame 324 in turn supports a central housing 340. Mounted in the housing 340 is a compressor or blower 372. The compressor 372 is driven by a motor 332 which is also supported in the housing 340. The flotation members 322 are designed to ride at the surface "S" of a large body of water or other liquid in a basin or the like. The compressor 372 is connected to an elongated downwardly extending hollow main center shaft 380.

The shaft 380 is rotatably mounted and is rotated by a motor also supported on the housing 340. More particularly, the motor 370 provides rotational power through a reduction gear arrangement 371 and a belt drive 373 to a drive wheel 375 fixed to the upper end of the main center shaft 380.

The rotatable shaft 380 carries at its lower end a diffuser or discharge assembly essentially like assembly 490 described above.

The illustrated housing 340 is pivotally mounted on the frame 324. The housing 340 is a generally rectangular box. A horizontal axle 350 extends from the housing and is supported at each end adjacent either side of the housing by a general triangular support 354 of the frame that is supported on one of the spaced apart floats 322.

The axle 350 is fixed to the supports 354 against rotation. The housing 340 is supported by but rotatable about the axle 350. A large gear wheel 356 within the housing is fixed to the axle 350.

A drive chain 358 extends around the large gear wheel 356 and around a small drive gear 360. The gear 360 is driven through a gear box 362 by a tilt motor 364. The motor 364 and gear box 362 are mounted in the housing 340.

When the motor 364 rotates the gear 360 to drive the chain 358, the entire housing 340 is caused to rotate about the gear wheel 356. This raises the shaft 380 and diffuser assembly 490 out of the liquid as shown in FIG. 3-4, so that compressor may be started or the discharge members 484 may be cleaned, repaired, the angle of incidence changed, etc.

Various modifications and changes may be made in the illustrated structures without departing from the spirit and scope of the present invention as set forth in the following claims.

What is claimed is:

1. Apparatus for mixing and introducing gas into a body of liquid, comprising:

a) a frame, b) a main shaft having a longitudinal axis, the shaft being mounted on the frame with its axis generally upright and extending down into the body of liquid, c) discharge means mounted on the shaft at a location below the surface of the body of liquid, the discharge means comprising a plurality of elongated spaced-apart radially-extending discharge members rotatable about the upright axis of the shaft, and d) drive means on the frame and connected to the discharge means for rotating the discharge means, each of the discharge members having a generally planer upwardly facing discharge surface that has a leading and a trailing edge, each member having closed lower portions, each discharge member having an interior passageway in communication with a source of gas under pressure, each discharge surface having perforations that communicate with the interior passageway of its discharge member, the discharge surfaces being inclined with their leading edges lower than their trailing edges at an angle that combines with the speed of rotation of the discharge members in a particular body of liquid to cause the resultant angle of attack of the liquid relative to the discharge surfaces to be generally zero or somewhat greater, the rotation of the discharge means causing flow of the liquid across said surface that shears the gas flowing out of the perforations to form bubbles of the gas, the bubbles being substantially smaller than would be produced if the discharge means were stationary.

2. The apparatus of claim 1 wherein the discharge means is proportioned to scan an area of at least about eight feet when it rotates.

3. The apparatus of claim 1 further including means for selectively fixing the angle of incline of the discharge surfaces at different predetermined angles.

4. The apparatus of claim 1 wherein said discharge members are shaped and proportioned to provide substantially more gas discharge at the radially outward portion of each discharge surface relative to the radially inward portion of that surface, at a generally progressive rate.

5. The apparatus of claim 1 wherein said drive means operates so as to maintain the speed of rotation of the discharge members sufficiently slow to avoid cavitation and excess energy consumption and sufficiently fast to effectively sheer the flow of gas discharge from the perforations to directly produce said flow of gas in bubble form.

6. The apparatus of claim 1 further including flotation means that supports the frame at the surface of said body of liquid.

7. The apparatus of claim 1 wherein said apparatus includes support cradle means that supports said main shaft and said discharge means for tilting up and out of the liquid body.

8. The apparatus of claim 1 further including means for raising and lowering the discharge members.

9. The apparatus of claim 8 wherein said raising and lowering means operates to generally vertically raise and lower the discharge members, and the apparatus also includes means for controlling the drive means to vary the speed of rotation of the discharge members so as to maintain, at different submersion depths of the discharge members, the resultant angle of attack at generally zero or somewhat greater.

10. The apparatus of claim 8 where the raising and lowering means is capable of raising the discharge means to a position where the discharge surfaces are generally at or above the surface of the liquid body, for start-up or other purposes.

11. The apparatus of claim 1 wherein the discharge surfaces, when stationary, collectively span no more than about 85 percent of the area of the circular disc spanned by the rotating discharge members.

12. The apparatus of claim 11 wherein the percentage of area spanned by the stationary discharging surfaces is about 50 per cent.

13. The apparatus of claim 1 further including a torque sensing device and a speed control means for selectively changing the speed of rotation in relation to changes in the torque sensed by said torque sensing device, such torque change being that experienced by the rotating discharge members, the change in speed being generally sufficient to maintain the resultant angle of attack of the liquid relative to the discharge surfaces at generally zero or somewhat greater.

14. The apparatus of claim 13 further including monitoring and control means for generally continuously monitoring the lift-pump-effect upward forces and automatically controlling said speed control means in relation to changes in said upward forces.

15. The apparatus of claim 14 wherein said monitoring and control means generally continuously monitor the torque being required to rotate the discharge means.

16. Apparatus for mixing and introducing gas into a body of liquid, comprising:

a) a frame, b) a main shaft having a longitudinal axis, the shaft being mounted on the frame with its axis generally upright and extending down into the body of liquid, c) discharge means mounted on the shaft at a location below the surface of the body of liquid, the discharge means comprising a plurality of elongated spaced-apart radially-extending discharge members rotatable about the upright axis of the shaft, and d) drive means on the frame and connected to the discharge means for rotating the discharge means, each of the discharge members having an upwardly facing discharge surface that has a leading and a trailing edge, each discharge member having an interior passageway in communication with a source of gas under pressure, each discharge surface having perforations that communicate with the interior passageway of its discharge member, the discharge surfaces being inclined with their leading edges lower than their trailing edges at such an angle that, for a predetermined speed of rotation of the discharge members in a particular body of liquid, causes the resultant angle of attack of the liquid relative to the discharge surfaces to be generally zero or somewhat greater, the rotation of the discharge means causing flow of the liquid across said surface that shears the gas flowing out of the perforations to form bubbles of the gas, the bubbles being substantially smaller than would be produced if the discharge means were stationary, gas at a higher pressure being discharged adjacent to the leading edge than adjacent to the trailing edge of each inclined discharge surface, to thereby tend to equalize gas discharge over the width of each discharge surface.

17. The apparatus of claim 16 where each discharge member has a plurality of separate elongated radially extending plenum, and gas at a higher pressure is generally progressively provided in the respective plenum as you proceed from the leading edge to the trailing edge of the associated discharge surface.

18. The apparatus of claim 17 wherein each discharge member has a main chamber that is in communication with the source of gas under pressure and that extends generally the length of the member, said plurality of plenum of that member being connected to and in communication with said chamber of that member, there being discharge ports between the chamber of each member and the associated plenum, said ports being sized and designed to allow progressively greater pressure to successive plenum as you proceed from the lower leading edge to the higher trailing edge of the associated discharge surface.

19. The apparatus of claim 18 wherein the ports between the chamber of each member and the plenum of that member at the lower leading edge of the member are proportioned to cause essentially no pressure reduction between such chamber and such leading edge plenum.

20. The apparatus of claim 18 wherein the pressure differential between the chamber of a member and the higher trailing edge superior plenum of that member generally equal the difference in static head pressure between the leading edge and the trailing edge of the discharge surface of that member.

21. The apparatus of claim 20 wherein each member has three or more of said plena.

22. The apparatus of claim 20 wherein the porting of each member is so designed that the flow of gas is generally equal across the width of the discharge surface of that member.

23. A method for mixing and introducing gas into a body of liquid, comprising the steps of:

1) positioning a plurality of elongated spaced-apart radially-extending rotatable discharge members generally horizontally and below the surface of the body of liquid, the members each having a generally upwardly facing discharge surface with perforations therein, the members also each having an interior passageway in communication with a source of gas under pressure and with the perforated discharge surface of that member, discharge surfaces being inclined with their leading edges substantially lower than their trailing edges, and 2) generally simultaneously, a) introducing gas under pressure to the interior passageways and discharging the gas through the perforations of the associated surfaces, and b) rotating the members around a generally upright axis at generally continuously determined speeds of rotation such that the discharging gas is sheared by the adjacent liquid to thereby directly produce a flow of the gas in bubble form, with the bubbles being substantially smaller in size than the size of bubbles than would be produced from the perforations if the discharge member were stationary, and the resultant angle of attack of the flow of the liquid relative to the discharge surfaces is generally zero or somewhat greater.

24. The method of claim 23 wherein said speed of rotation is between at 2 RPM and about 25 RPM.

25. Apparatus with improved control means for mixing and introducing gas bubbles into a body of liquid, comprising, a) a frame, b) a main shaft having a longitudinal axis, the shaft being mounted on the frame with its axis generally upright and extending down into the body of liquid, c) discharge means mounted on the main shaft at a location below the surface of the body of liquid, the discharge means being rotatable about the upright axis of the main shaft, d) drive means on the frame for rotating the discharge means, the discharge means having an interior passageway in communication with a source of gas under a constant pressure, said discharge means having a discharge surface that has perforations that communicate with the passageway of the discharge means, rotation of the discharge means causes a flow of the liquid across said surface that shears the gas flowing out of the perforations to form small bubbles of the gas that are substantially smaller would be produced if the discharge means were stationary, e) submersion means for selectively raising and lowering the discharge means to change the depth of submergence of the discharge means as it rotates to change the pressure exerted by the body of liquid above the discharge surface and thereby selectively change the rate of gas introduction into the body of liquid, f) input means to provide input pertinent to the desired level of aerating and mixing of the body of liquid and energy consumption, and g) control means to cause the submersion means to raise or lower the discharge means in response to the input of the input means.

26. The apparatus of claim 25 further including a positive displacement compressor for providing the source of gas under generally constant flow and with pressure proportional to the depth of submergence of the members.

27. The apparatus in claim 25 further including a monitor means for monitoring and providing input as to a desired parameter related to the body of liquid, said control means receiving signals from the monitor means and causing the submersion means to automatically raise or lower the discharge means such that said parameter is generally maintained at about a predetermined set point under varying conditions in the liquid body.

28. The apparatus of claim 25 further including speed control means to adjust the speed of rotation of the members in response to changes in depth of the discharge means so as to generally maintain the angle of attack of the discharge surface at about zero or somewhat greater.

29. The apparatus of claim 25 further including downwardly facing scrubbing means affixed to the frame above the discharge means, the discharge means being capable of being raised by the control means, while the discharge means are rotating, to bring its discharge surface into engagement with the scrubbing means to scrub such discharge surface.

30. The apparatus of claim 29 further including downwardly directed cleaning jets on the frame above the discharge means and operable, when the discharge means are raised and rotating, to direct of high pressure flow of cleaning liquid against the discharge surface to thereby clean and remove debris from such surface.

31. A method for mixing and introducing gas into a body of liquid, comprising the steps of:

1) positioning a plurality of elongated spaced-apart radially-extending rotatable discharge members generally horizontally and below the surface of the body of liquid, the members each having a generally upwardly facing discharge surface with perforations therein, the members also each having an interior passageway in communication with a source of gas under pressure and with the perforated discharge surface of the member, the members being inclined with their leading edges substantially lower than their trailing edges, 2) generally simultaneously:

a) introducing gas under pressure to the interior passageways and discharging the gas through the perforations of the associated surfaces, and b) rotating the members around a generally upright axis, so that the discharging gas is sheared by the adjacent liquid to thereby directly produce a flow of the gas in bubble form, with the bubbles being substantially smaller in size than the size of bubbles than would be produced from the perforations if the discharge member were stationary, 3) providing input pertinent to the desired level of aeration and mixing of the body of liquid and energy consumption, and 4) selectively changing, in predetermined relation to such input, the depth of the members in the liquid body while they rotate to change the pressure exerted by the liquid body above the discharge surfaces and thereby change the rate of gas introduced into the body of liquid and energy consumed.

32. Apparatus for mixing and introducing gas bubbles and an admixture into a body of liquid, comprising, a) a frame, b) a main shaft having a longitudinal axis, the shaft being mounted on the frame with its axis generally upright and extending down into the body of liquid, the shaft having a first duct therealong for receiving a compressed gas and a second duct therealong for receiving an admixture, c) discharge means mounted on the main shaft at a location below the surface of the body of liquid, the discharge means being rotatable about the upright axis of the shaft, and d) drive means on the frame and connected to the discharge means for rotating the discharge means, the discharge means having a first interior gas passageway in communication with the first duct of the shaft, the discharge means having a generally upwardly facing gas discharge surface that has perforations that communicate with the first gas passageway of the discharge means, the rotation of the discharge means causing flow of the liquid across said surface that shears the gas flowing out of the perforations to form small bubbles of the gas, the bubbles being substantially smaller than would be produced if the discharge means were stationary, the discharge means having a second interior admixture passageway in communication with the second duct of the shaft, the discharge means having a plurality of admixture outlets that are in communication with the admixture passageway for releasing admixture into the liquid body as the discharge means rotates.

33. The apparatus of claim 32 wherein the discharge means is in the form of a plurality of elongated radially extending discharge members, each have a leading and a trailing edge, and there are two admixture passageways in each member, one along the leading edge and one along the trailing edge.

34. The apparatus of claim 32 wherein there is a source of admixture on the frame in communication with the admixture duct.

35. The apparatus of claim 32 wherein the outlets for release of the admixture into the body of liquid are in the form of nozzles that are progressively larger and/or more numerous as they extend from the radically inner end to the radially outer end of the discharge members.

36. The apparatus of claim 32 wherein the discharge members each have a trailing edge, and said outlets are in the form of nozzles arranged along the trailing edges to provide reactive forces when admixture is discharged from the nozzles to tend to rotate the members.

37. The apparatus of claim 32 where the discharge members each include a perforated upwardly facing admix discharge surface, at least one admix plenum that is immediately below said admix discharge surface, that is separated from the flow of compressed gas, and that is in communication with the admixture passageway so as to allow admixture to pass from the admixture passageway to the admix plenum and then out through the performed admix discharge surface.

38. The apparatus of claim 37 wherein said admix discharge surface is adjacent to said gas discharge surface.

39. A method for mixing and introducing gas and an admixture into a body of liquid, comprising the steps of:

a) positioning a plurality of elongated discharge members generally horizontally and below the surface of the body of liquid, the members each having a first interior passageway connected to a source of gas and a second interior passageway connected to a source of admixture, the members also each having a generally horizontal flat discharge surface with perforations therein in connection with the associated first gas passageway, the members also each having admixture ports in communication with the associated admixture passageway and located in close proximity to the discharge surface of the associated member, b) generally simultaneously:

1) introducing gas under pressure into the first interior passageways, 2) introducing admixture under pressure into the second interior passageways, and c) rotating the elongated discharge members around a generally upright axis so that gas in fine bubble form is discharged from the perforations and admixture is discharged from the ports and mixed into the liquid of the body.

* * * * *